US005260753A

United States Patent [19]

Haneda et al.

[11] Patent Number: 5,260,753

[45] Date of Patent: Nov. 9, 1993

[54] COLOR IMAGE FORMING METHOD

[75] Inventors: Satoshi Haneda; Masato Ueda; Tadashi Miwa; Masakazu Fukuchi, all of Hachioji, Japan

[73] Assignee: Konica Corporation, Tokyo, Japan

[21] Appl. No.: 790,424

[22] Filed: Nov. 12, 1991

[30] Foreign Application Priority Data

Nov. 14, 1990 [JP] Japan ..... 2-308342
Nov. 16, 1990 [JP] Japan ..... 2-310272
Nov. 16, 1990 [JP] Japan ..... 2-310273

[51] Int. Cl.[5] ..... G03G 15/20

[52] U.S. Cl. ..... 355/282; 355/208; 355/285; 355/290; 355/326 R; 430/45; 430/47; 430/124

[58] Field of Search ..... 355/282, 285, 289, 290, 355/295, 278, 294, 293, 326, 328, 218, 208, 200, 202, 204; 430/45, 47, 124

[56] References Cited

U.S. PATENT DOCUMENTS 3,799,773 3/1974 Watarai et al. ..... 430/45
4,040,828 9/1977 Evans ..... 430/45 X
4,756,985 7/1988 Haueda et al. ..... 430/45 X

FOREIGN PATENT DOCUMENTS 81887 6/1983 European Pat. Off. .
0025215 6/1984 Japan ..... 430/45
0025216 6/1984 Japan ..... 430/45
0123055 5/1988 Japan ..... 430/124

OTHER PUBLICATIONS

*Xerox Disclosure Journal*, vol. 16, No. 1, Jan./Feb. 1991, p. 69, Bares, Jan, "Color Prints with Uniform Gloss".
Patent Abstracts of Japan, Publication No. JP 63058374, Publication date Mar. 14, 1988, Abstract vol. 12278; JPA-86-201 849.
Patent Abstracts of Japan, Publication No. JP 63092964, Publication date Arp. 23, 1988, Abstract vol. 12331; JPA-86-23 7226.
Patent Abstracts of Japan, vol. 8, No. 133 (P-28) [1570]; Jun. 20, 1984 JPA-59-34541; Feb. 24, 1984.
Patent Abstracts of Japan, Publication No. JP63092965, Publication date Apr. 23, 1988, Abstract vol. 12331; JPA-86-237,227.

*Primary Examiner*—A. T. Grimley
*Assistant Examiner*—Matthew S. Smith
*Attorney, Agent, or Firm*—Jordan B. Bierman

[57] ABSTRACT

The invention provides a method of forming a color image on a recording material by transferring a toner image formed on an image carrying means to the recording material and by fixing the toner image on the recording material. The method further includes adhering a transparent toner layer onto the recording material, and fixing the transparent toner layer together with the toner image on the recording material.

12 Claims, 18 Drawing Sheets

COLOR IMAGE FORMING METHOD

BACKGROUND OF THE INVENTION

The present invention relates to a color image forming method whereby deep images which have a superior color tone can be obtained.

When the conventional eletrophotographic method is used to form color images, there is a method available that image data for each color, which is obtained, for example, by reading a document by a color CCD and performing image processing and color correction, is created on a photo conductor using an inorganic photo conductive material such as ZnO, CdS, Se, or amorphous silicon or a photo conductor using an organic photo conductive material such as phtalocyanine pigment, bis-azo pigment, or polycyclic quinone pigment, an electrostatic latent image is formed for each color by irradiating a laser beam which is modulated by the above image data, the latent image is developed by a color toner, for example, yellow (Y), magenta (M), cyan (C), or black (BK), the color toner image, whenever it is formed, is transferred to a transfer material so as to form a color toner image on the transfer material, and the image is fixed by heating so as to form a color image.

There is an another method available that color toner images are superimposed on a photo conductor so as to form color toner images, and the color toner images are transferred to a transfer material in a batch and fixed so as to form a color image.

Each of the above color toners comprises particles 1 to 20 μm in diameter which are obtained by dispersing a pigment as a coloring agent in a binder resin. The above color toner images are formed by color toner particles which are at least partially overlapped and at least a part of color toner particles are melted by heating, and fused and fixed.

The following can be used as coloring agents.

Y coloring agent: Benzine yellow, quinoline yellow, Hansa yellow

M coloring agent: Rhodamine B, rose Bengal, pigment red

C coloring agent: Phthalocyanine blue, aniline blue, pigment blue

BK coloring agent: Carbon black, aniline black, furnace black, color toner blend As to each of the above color toners, the light transmittance as a coloring agent is not good and the toner particle shape remains after fixing. Therefore, much of light irradiated to the obtained color image is diffusedly reflected off of the surface and little reflected light is obtained from the color layer, and hence the image is not deep and the color tone reproducibility is not good. Therefore, the image is observed as a flat image.

FIG. 10 shows the status of reflected light when light is irradiated to a color image after conventional fixing. Numeral 1 indicates a transfer material such as paper, 2 a color image, 2C a cyan (C) toner image layer, 2M a magenta (M) toner image layer, and 2Y a yellow (Y) toner image layer. Light 3 is diffusedly reflected off of the Y toner image layer, which is an uppermost layer, like diffusedly reflected light 4 and 3D, and a part of it transmits into the layers, is absorbed by the 2Y, 2M, and 2C layers, and reflected off like 3Y, 3M, and 3C. A color image can be observed by an eye 5 from those reflected lights. In this case, the reflected light from the surface of the uppermost toner layer is intensive and the reflected lights from the inner toner layers are weak.

Therefore, the image color tone is not good and a flat and shallow image is obtained.

Therefore, compared with, for example, silver halide color photographs comprising Y, M, and C fine particle dye layers which have superior light transmittance or sublimation heat transfer copies, the image deepness and color tone are extremely inferior.

In view of the above mentioned, Japanese Patent Application Laid-Open Nos. 1988-92964 and 1988-92965 propose a color image forming method which uses a transfer material comprising a base with a white area which is coated with a transparent resin layer.

The first object of the present invention is to provide color images which have the color tone of silver halide photographs and are deep by using the electrophotographic method.

The present invention relates to a color image forming apparatus such as an electrophotographic copying apparatus which forms a copy image which is partially or entirely glossy.

In some of conventional image forming apparatuses such as an electrophotographic copying apparatus, the development conditions are kept constant by using a means for automatically feeding toners (developers) by monitoring the density of each toner, or the development conditions are changed depending on measurement results of the mean density of a document so as to obtain a copy which is faithful to the document as much as possible and can be read easily. However, an apparatus which measures the glossiness of a document during image read and makes a copy image glossy partially or entirely in correspondence with the document according to the measurement results is not realized yet.

Therefore, the conventional image forming apparatus imposes a problem such that a copy of a glossy document is different in feeling from the document because plain paper is used as a transfer material, or the density of characters or the saturation of a color copy decreases due to changing of image data. The gloss of silver halide photographs cannot be reproduced on plain paper, and it is extremely difficult to reproduce a document containing printed, copied, and silver halide images simultaneously.

As to an image recorded on a transparent sheet used for an overhead projector, diffused reflection of the transmitted light can be prevented by making the image surface glossy and a clear projected image with high saturation can be obtained. Therefore, a transferred image with high glossiness is required.

The second object of the present invention is to provide a color image forming apparatus which records a copy image on a transfer material as a glossy image including a portion with no toner image formed, which is not affected by the quality of the transfer material, so as to meet the above demand.

Furthermore, the present invention relates to a color image forming method of an image forming apparatus such as an electrophotographic copying apparatus which makes an image on a transfer material glossy.

The third object of the present invention is to provide a color image forming method which records a copy image on a transfer material as an even and glossy image, which is not affected by the quality of the transfer material, so as to meet the above demand.

SUMMARY OF THE INVENTION

The above objects are accomplished by a color image forming method comprising a process for transferring a toner image formed on an image forming unit onto a transfer material and a process for heating and fixing the toner image transferred onto the transfer material, which is characterized in that without using a transfer material having a transparent base layer on the base, the method produces the same result, that is, a color image forming method comprising a process for transferring and fixing a toner image on an image forming unit onto a transfer material which is characterized in that the method comprises a process for adhering a transparent toner particle layer to the transfer material on the base having a white portion as a transfer material and then fixing it.

A desirable embodiment of the present invention is that a transparent toner particle layer is formed on the above image forming unit in addition to the above toner image and the toner image and transparent toner particle layer are transferred to and fixed on the transfer material so as to form a color image having a transparent coating layer.

Another desirable embodiment of the present invention is that a transparent toner particle layer is formed on the transfer material by direct non-contact development and a toner image and a transparent toner particle layer are formed on the transfer material by transferring the above toner image formed on the image forming unit and then fixed so as to form a color image having a transparent coating layer.

The image forming method of the present invention is characterized in that when a toner image formed on an image forming unit by the electrophotographic method is transferred to a transfer material and melted and fixed by heating so as to form a color image, the color image is formed by providing and fixing a transparent toner particle layer and a color toner image by using a conventional transfer material so as to increase the quantity of reflected light from the color layers constituting the color image layer and obtain a deep image.

The present invention is effective in preventing diffused reflection for a transparent base such as OHP.

Figure 1:
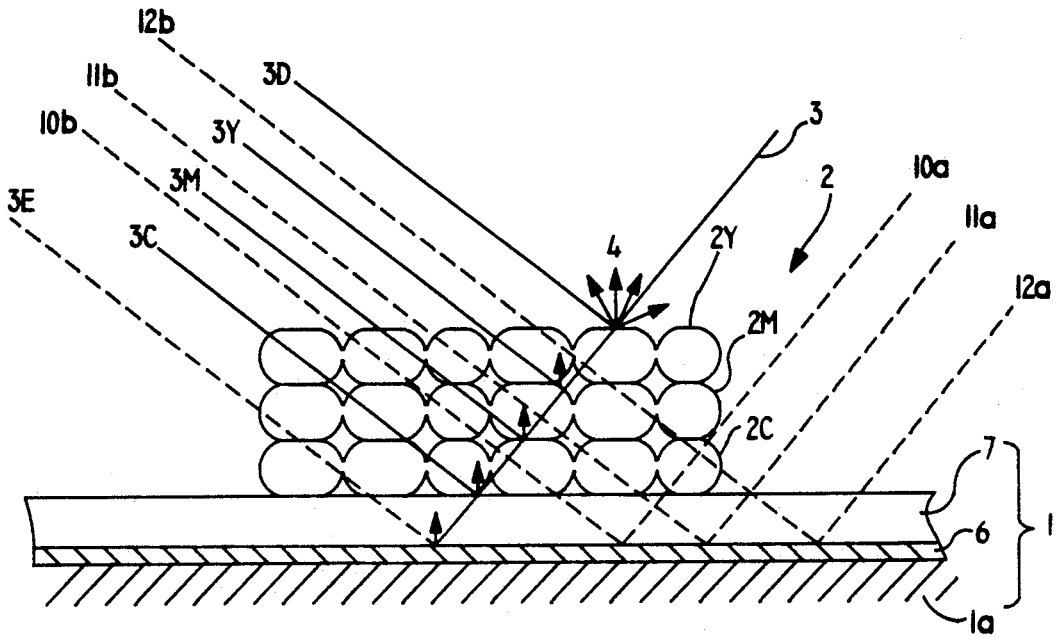
FIG. 1 is an illustration showing the status of reflected light of an example of a color image of the present invention.
Figure 2:
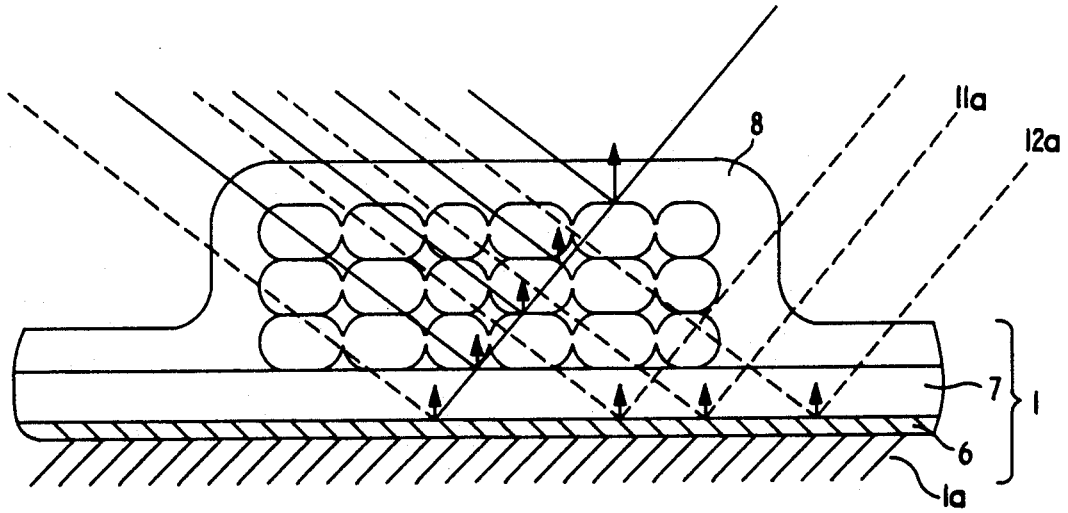
FIG. 2 is an illustration showing the status of reflected light of another example of a color image of the present invention.

The transfer material used in the present invention may be, as shown in FIGS. 1 and 2, paper sheets of wood pulp fibers, coated paper, synthetic paper, plastic sheets, or metal sheets as a material la of transfer paper 1, though paper sheets of pulp fibers are generally used. A white reflection surface 6, which is a white portion, may be formed on the material 1*a* of a paper sheet by putting a white dye such as CaO, BaO, SrO, $ZnO_2$, $TiO_2$, or $BaSO_4$ in paper sheets in the manufacture process or by coating a thin resin layer containing dispersed white dye on the paper sheet surface. The thickness of paper sheets having the above white reflection surface 6 ranges from 20 $\mu$m to 100 $\mu$m.

As a transparent base layer 7, which is a resin layer formed from transparent toner formed on the above white reflection surface 6, a resin layer, which transmits visible rays, has a melting point of more than 100° C., does not change its color, and can be adhered to the paper sheet material and toner layers, is used. The resin is selected from the ones indicated below, which are generally used for electrophotographs.

Those resins are as follow: Polystyrene, acrylic resin, styrene-acrylic resin, styrene-butadiene resin, polyvinylchloride resin, vinyl acetate resin, vinyl chloride-vinyl acetate copolymer, vinyl chloride-vinyl acetate-maleic acid copolymer, polyester resin, polyurethane resin, polyimide resin, polyamide resin, epoxy resin, vinylbutyral resin, and polyvinyl alcohol resin.

From transparent toner produced from one of the above resins, the transparent base layer 7 or transparent coating layer 8 is formed so that a fixing film on the white reflection surface 6 ranges from 5 to 40 μm in thickness so as to produce refined images relating to the present invention.

One of the color image forming methods which are applied to the present invention is that a belt type photo conductor, for example, such as a Sharp color copying apparatus CX-7500 is used, C, M, Y, and BK color toner images are formed on the photo conductor by the analog method, each color toner image is transferred onto an intermediate transfer belt whenever it is formed, a color toner image is formed by superimposing each color toner image on the belt, and the color toner image is transferred to and fixed on the above special transfer material so as to form a color image. Another method is that a color image signal is read by a color scanner, for example, like a digital color copying apparatus indicated in Japanese Patent Application Laid-Open No. 1986-111071, a laser beam modulated by the color image signal is exposed to a photo conductor so as to form an electrostatic latent image, the electrostatic latent image is reversely developed by a C, M, Y, or BK color toner so as to form a color image.

In this case, each color toner image formed on the photo conductor is transferred to the transfer material, which is wound and secured round the transfer drum, whenever it is formed, and a color toner image is formed by superimposing those color toner images on the transfer material. After the transfer material is separated from the drum, the color toner image is fixed so as to form a color image.

In a color image forming apparatus such as a digital color copying apparatus or a color printer which is indicated in Japanese Patent Application Laid-Open No. 1984-34546 or 1984-61865, a color toner image is formed by superimposing Y, M, C, and BK color toner images on the photosensitive drum by several rotations of the drum by the digital method. Color toner images formed on the photo conductor are transferred to and fixed on the above special transfer material in a batch so as to form a color image. This color image forming apparatus has an advantage that toner images are superimposed precisely and color images with superior resolution are obtained.

When any of the various color image forming methods mentioned above is used, deep color images with high quality can be obtained by using the special transparent toner particle layer forming method of the present invention.

Figure 10:
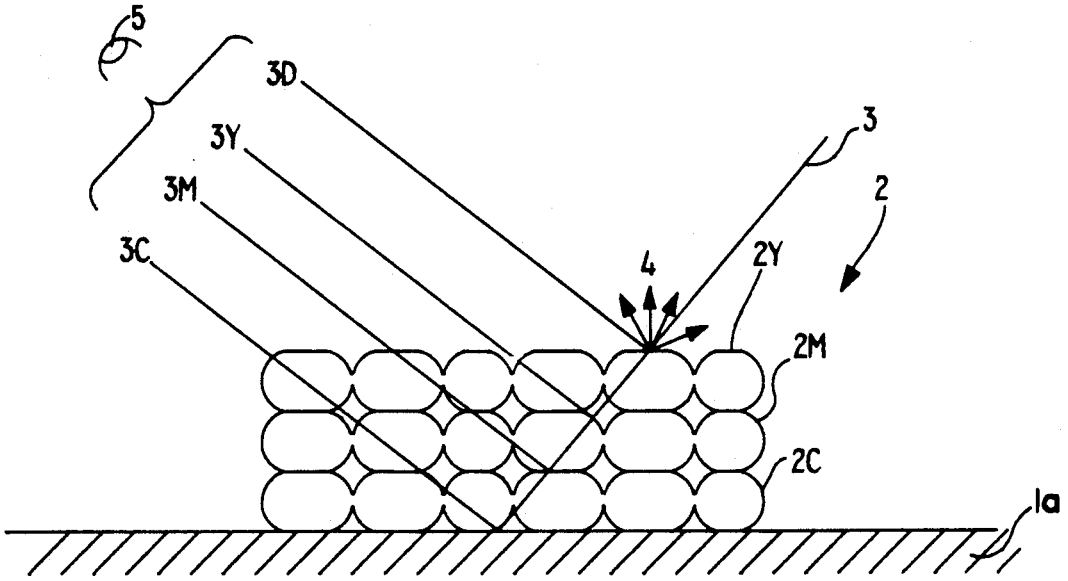
FIG. 10 is an illustration showing the status of reflected light of a conventional color image.

FIGS. 1 and 2 are illustrations showing the reflection status of light when a color image of the present invention is formed by a transfer material, and the same number is assigned to the same item as the one shown in FIG. 10. In the drawings, numeral 6 indicates a white reflection surface which is a white area, 7 a transparent base layer of transparent toner particles, 8 a transparent coating layer which is a resin layer of transparent toner particles, 10*a*, 11*a*, and 12*a* marginal lights, and 10*b*, 11*b*, and 12*b* reflected lights thereof. Transfer paper has no white reflection surface 6 generally, and serves as transfer paper la. In FIG. 1, unlike FIG. 10, in addition to reflected lights 3Y, 3M, and 3C from toner image layers 2Y, 2M, and 2C constituting a color image 2, the reflected light 10*b*, 11*b*, and 12*b* of the marginal lights via the transparent base layer 7 having the toner layers as lower layers and the white reflection surface 6 and 3E are added. Therefore, the light quantity reaching eyes increases and the color tone becomes high, and deep images can be obtained. FIG. 2 shows an example when the transparent coating layer 8 having a transparent toner particle layer which is fixed onto the color image shown in FIG. 1 is formed. A deep and glossy color image can be obtained.

Irregularities in FIGS. 1, 2, and 10 are exaggerated, though they are melted and smoothed by heat of a fixing unit.

The second object of the present invention is accomplished by a color image forming apparatus fixing toner images on the transfer material which is characterized in that when images different in glossiness are selectively formed on the transfer material, the above image area selectively forms a transparent layer.

The third object of the present invention is accomplished by a color image forming method which is characterized in that a color toner image formed on the transfer material comprises an area where fixed color toner is adhered and an area where transparent toner is adhered and the amount of adhered toner in each area is almost equal.

DETAILED DESCRIPTION OF THE PREFERRED EMBODIMENTS

Next, embodiments for accomplishing the first object of there are no restrictions on them.

Embodiment I-1

(Y→M→C→BK→T)

Figure 3:
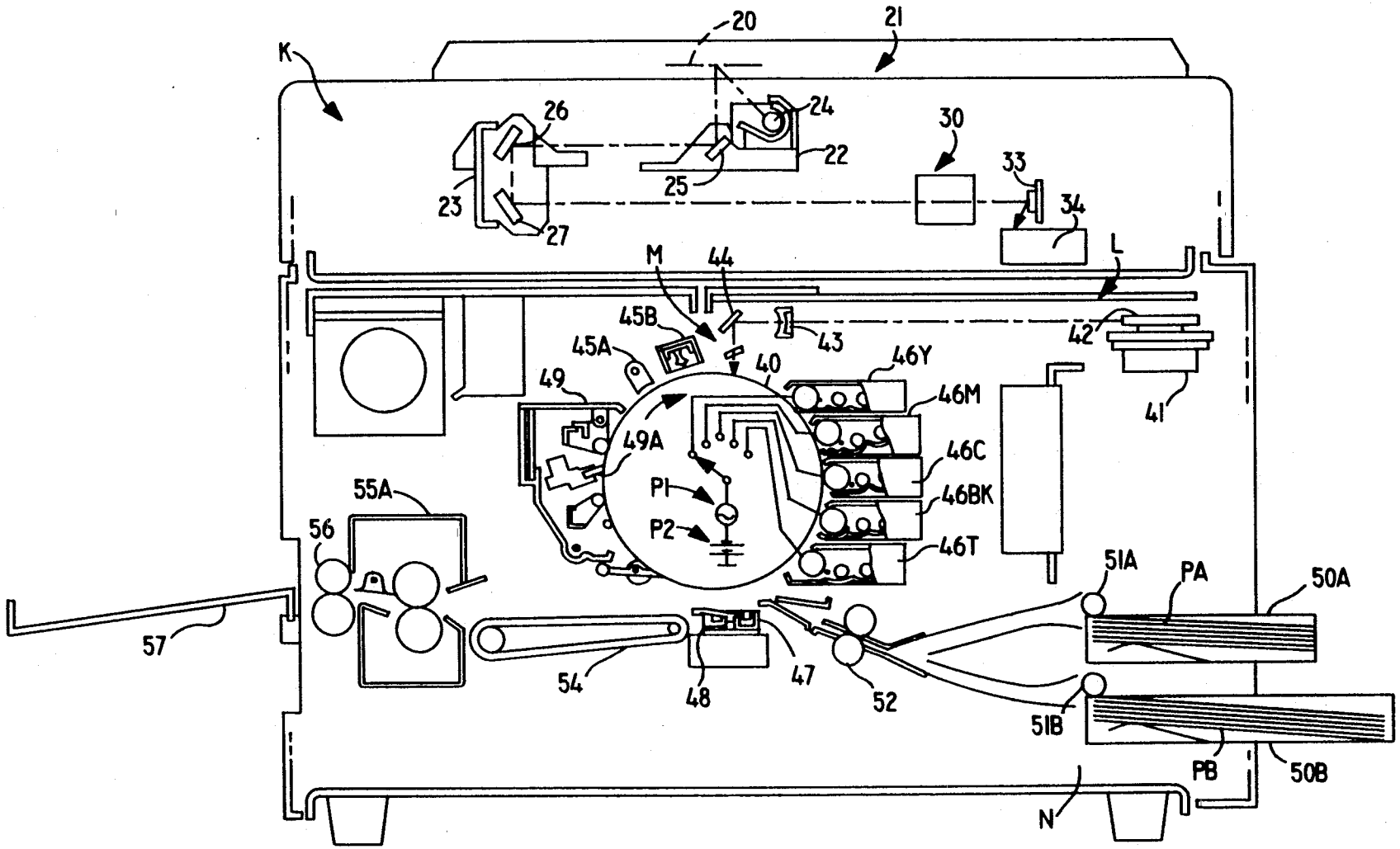
FIG. 3 is a sectional view of a color image forming apparatus of Embodiment I-1 whereto the present invention is applied.

FIG. 3 is a sectional view of a color image forming apparatus for explaining the image forming method of this embodiment. A symbol K indicates an image scanning section, L units of a laser writing section, M an image forming section, and N paper feed section.

The image scanning section K comprises a carriage 22 where a mirror 25 and a tungsten halogen lamp are mounted, a movable mirror unit 23 where mirrors 26 and 27 are mounted, a color CCD 33 having a lens 30 and a color resolution filter, and an image processor 34.

The laser writing section L comprises a motor 41 and a rotational polygon mirror 42. The image forming section M comprises a photo conductor 40 which is an image forming unit having an organic photoconductive layer including bis-azo pigment, a pre-exposure lamp 45A, a scorotron charging unit 45B for charging the photo conductor surface at, for example, −700 V, developing units 46Y, 46M, 46C, 46BK, and 46T which are filled with developers including negative polarity toners of Y, M, C, BK, and T (transparent) whereto AC bias voltage P1 and DC bias voltage P2 are alternately applied only during development, a transfer electrode 47 which transfers color toner images formed on the photo conductor 40 to transfer paper (transfer material) in a batch, a separation electrode 48, a fixing unit 55 for fixing the above color toner images, and a cleaning unit 49 having a cleaning blade 49A for removing toner remaining on the photo conductor 40.

The paper feed section N comprises feed rollers 51A and 51B and a timing roller 52 for feeding transfer paper PA or PB (transfer material) to the transfer electrode 47 and the separation electrode 48 from a paper feed cassette 50A or 50B.

The above transfer paper PA or PB is wood free paper 50 μm in thickness which is laminated with a polyvinyl butyral layer 1 μm in thickness containing 5 wt % of dispersed $ZnO_2$ and furthermore laminated with a vinyl chloride-vinyl acetate copolymer layer 5 μm in thickness thereon.

Figure 4:
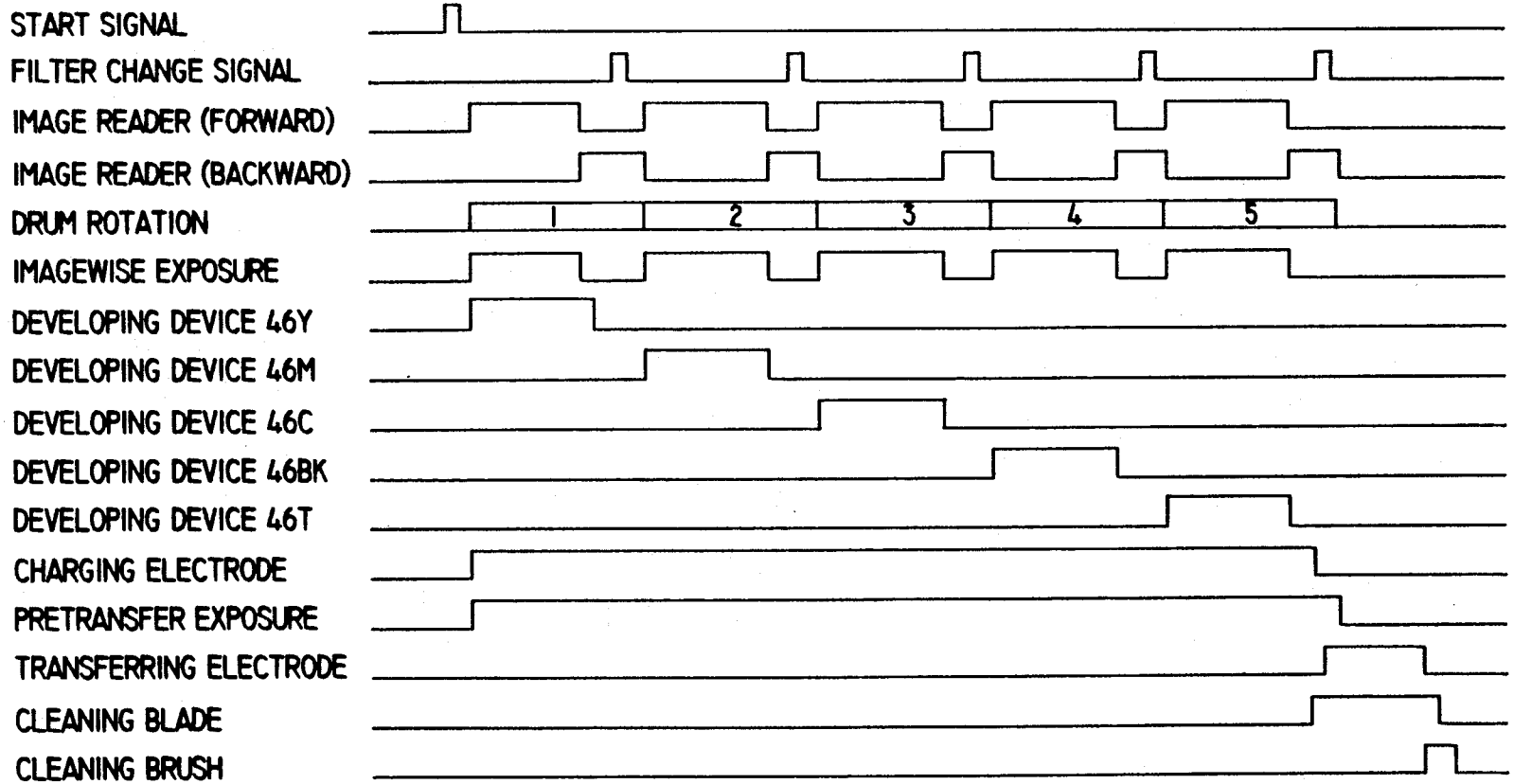
FIG. 4 shows a time chart of the image forming process of Embodiment I-1 of the present invention.

The color image forming apparatus configured as mentioned above forms images according to the time chart shown in FIG. 4.

The copy button is tuned to ON and an initialize signal is outputted to the image scanning section K via a control circuit. A document 20 on a document plate 21 of the image scanning section K is optically scanned by the tungsten halogen lamp 24 of the carriage 22 during the first rotation of the photo conductor, and an optical image of the document is formed on the light receiving surface of the color CCD 33 via the lens 30 and the mirrors 25, 26, and 27, which are driven by a stepping motor, and converted to an electric signal. The obtained electric signal is subjected to signal processing such as A-D conversion, shading correction, gradation correction, color conversion, ghost processing, and multi-leveling, and a Y image signal, which is a first color signal, is outputted to the next laser writing section L. A 810 nm laser beam generated from the laser source is modulated in pulse width by the above Y image signal, rotationally scanned by the rotational polygon mirror 42 which is driven by the motor 41, passes through a $f\theta$ lens 43, bends its path by a mirror 44, and is exposed as an image onto the photo conductor surface which is pre-exposed by the pre-exposure lamp 45A and uniformly charged by the charging unit 45B so as to form an electrostatic latent image. This electrostatic latent image is developed by a two-component developer containing Y toner, which is filled in the developing unit 46Y, by the non-contact reversal development method at the above AC and DC bias voltages so as to form a Y toner image. The obtained Y toner image, which is retained on the photo conductor 40, passes under the cleaning unit 49 which is separated from the photo conductor 40 and is transported to the charging unit 45B during the second rotation of the photo conductor 40 so as to form the next M toner image.

The photo conductor 40, which retains the Y toner image, is negatively charged by the charging unit 45B, and a laser beam is exposed as an image according to an M image signal, which is a second color signal from the image processor 34, by the next scanning of the image scanning section K so as to form an electrostatic latent image. This electrostatic latent image is reversely developed by the developing unit 46M in the same way as with the developing unit 46Y and an M toner image is superimposed on the Y toner image.

During the 3rd and 4th rotations of the photo conductor 40, in the same way, by laser beam image exposure according to a C image signal, development by the developing unit 46C, laser beam image exposure according to a BK image signal, and development by the developing unit 46BK, a C toner image and a BK toner image are superimposed on the Y and M toner images on the photo conductor 40 so as to form a color toner image. As to a method for forming a transparent toner particle layer, the image scanning section K, the charging unit 45B, and the laser writing section L are left unoperated, the photo conductor 40 is uniformly pre-exposed by the pre-exposure lamp 45A by non-contact reversal development so as to discharge it, and a uniform transparent toner particle layer is formed on the photo conductor 40 by non-contact reversal development by the developing unit 46T. As to another method for forming a transparent toner particle layer, the image scanning section K, the laser writing section L, and the pre-exposure lamp 45A are left unoperated, the potential of the photo conductor is uniformed by operating the charging unit 45B, and a uniform transparent toner particle layer can be formed by performing reversal development by applying a development bias voltage having a DC component, which is higher than this potential, to the development sleeve. A transparent toner particle layer may also be obtained by uniforming the potential of the photo conductor by operating the charging unit 45B, discharging the photo conductor by uniform exposure of the laser writing section L, and adhering transparent toner particles to the photo conductor by reversal development. In this case, black toner which transmits a laser beam is desirable. The transparent toner particle layer and color toner images are transferred to the transfer paper PA (A4 size, lateral feed) having the above configuration, which is transported to the transfer area from the paper feed cassette 50A via the feed roller 51A and the timing rollers 52 in synchronization with image forming, in a batch by the action of the transfer electrode 47. The paper feed cassette 50B is used for transfer paper PB (B4 size, longitudinal feed).

The transfer paper PA whereto the transparent toner particle layer and color toner images are transferred is separated from the photo conductor 40 by the separation electrode 48, transported to a heat roller fixing unit 55 by a conveyor belt 54, and heated and fixed by the fixing unit 55 so as to form a color image having the transparent toner particle layer as a lower layer, and ejected to a paper ejection tray 57 by paper ejection rollers 56.

In this embodiment, a negatively charged organic photo conductor is used, and developers used for the two-component non-contact developing units 46Y, 46M, 46C, 46BK, and 46T are as follows:

| | |
|---|---|
| Styrene methacrylate butyl copolymer resin: | 100 part by weight |
| Coloring agent: | 10 part by weight |
| Charge control agent: | 0.2 part by weight |
| Polypropylene, softening point 120° C.: | 2 part by weight |

The above components are melted, kneaded, cooled, crushed, and classified so as to obtain toner 10 μm in diameter having a charge of −15 μc/g.

Carrier Manufacturing Method

Spherical ferrite particles 40 μm in diameter are coated with styrene resin layers 0.5 μm in thickness.

Developer Adjustment

Each developer contains carrier, toner of 5 wt % of carrier, and hydrophobic silica of 0.5 wt % of carrier.

Transparent toner is toner with coloring agent removed. As a coloring agent in toner, Benzidine yellow is used in toner for the developing unit 46Y, Rhodamine B for the developing unit 46M, copper phtalocyanine for the developing unit 46C, and the above coloring agents, which are blended, for the developing unit 46BK. This black toner transmits a laser beam generated from a semiconductor laser.

Embodiment I-2

(T→Y→M→C→BK)

Figure 5:
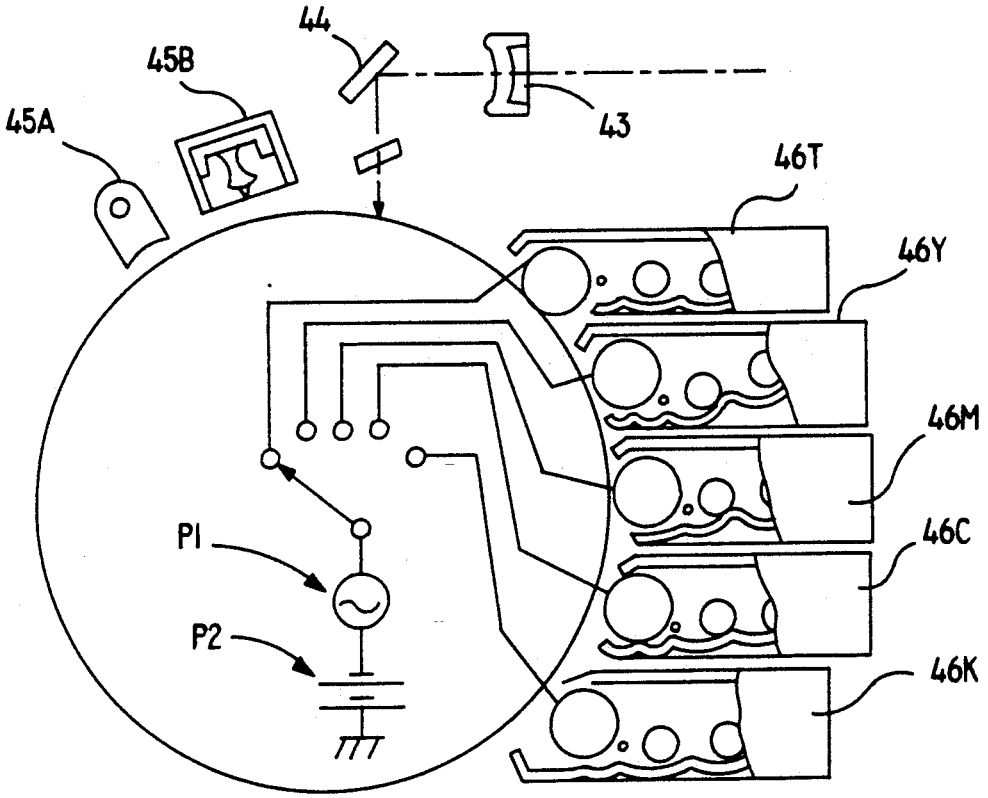
FIG. 5 shows a layout of developing units of Embodiments I-1 and I-4 of the present invention.
Figure 6:
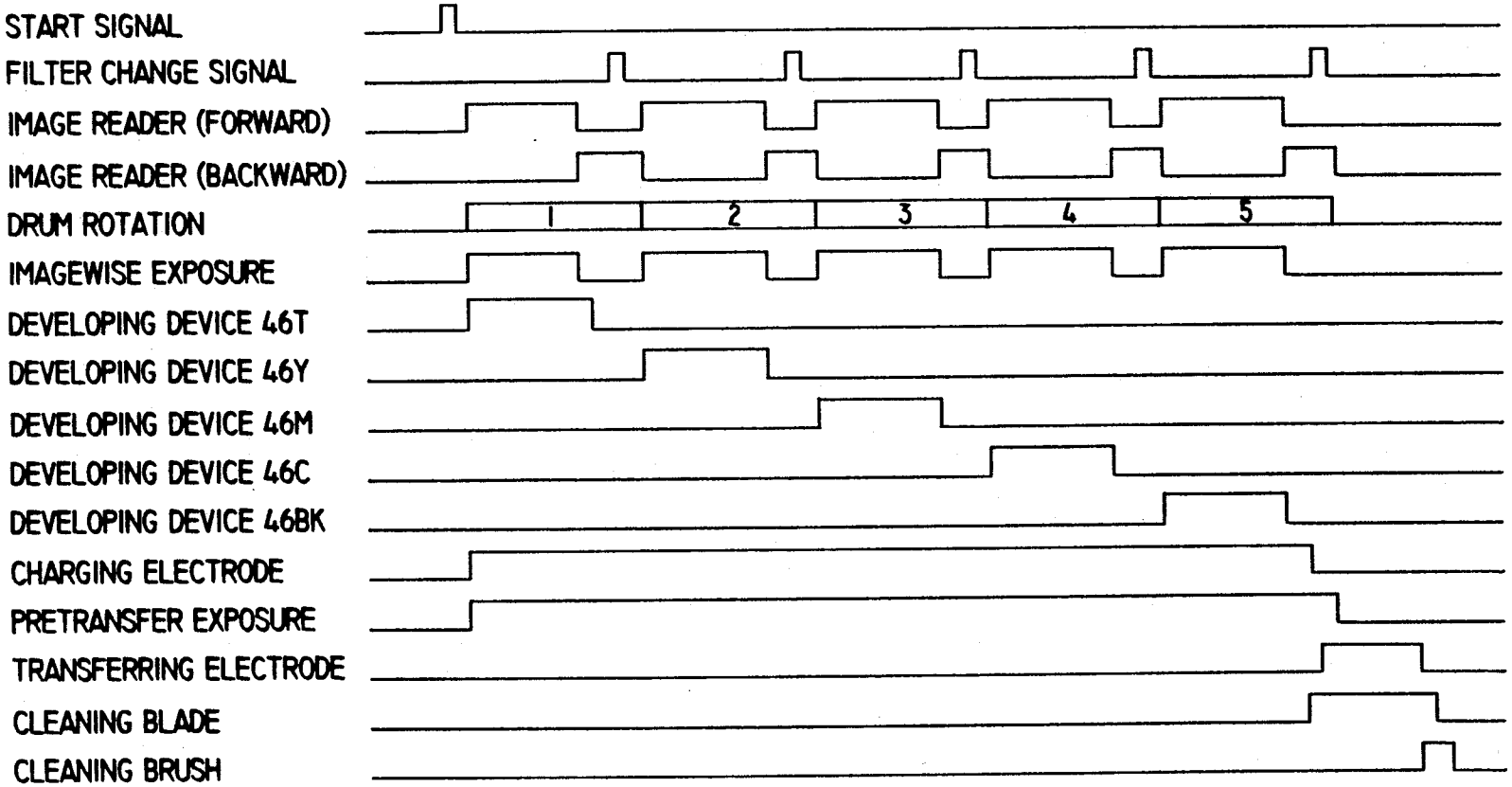
FIG. 6 shows a time chart of the image forming process of Embodiment I-2 of the present invention.

In this embodiment, the developing units 46 used in Embodiment I-1, which use the non-contact reversal development method, are located in the order of 46T, 46Y, 46M, 46C, and 46BK for the photo conductor 40 as shown in FIG. 5, and images are formed by a color image forming apparatus which is the same as that used in Embodiment I-1, except that development starts with the transparent toner in the developing unit 46W as shown in the time chart in FIG. 6.

As an image forming method, during the first rotation of the photo conductor at the time of copy start, the image scanning section K, the charging unit 45B, and the laser writing section L are left unoperated, a uniform transparent toner particle layer is formed on the photo conductor 40 which is uniformly pre-exposed by the pre-exposure lamp 45A and negatively charged by non-contact reversal development by the developing unit 46T. By executing the image forming method comprising charging, image exposure, and reversal development shown in Embodiment I-1 for the above transparent toner particle layer, color toner images are formed by superimposing Y, M, C, and BK toner images, and the color toner images containing the above transparent toner particle layer are transferred to the transfer paper PA in a batch in the same way as with Embodiment I-1 and fixed by a heat roller so as to form a color image with a transparent coating layer 8.

COMPARISON EXAMPLES I-1 AND I-2

Color images are formed in the same way as with Embodiments I-1 and I-2 except that no transparent toner is used.

In Embodiments I-1 and I-2, color images are deep in quality and superior in color tone and gradation, resulting in deep color images. In the comparison examples, the color tone and gradation are not good, and color images are flat.

Especially in Embodiment I-1, since transparent toner is used finally, superimposition of color toner images to the photo conductor is not affected, and since the transparent toner particle layer becomes a lower layer on the transfer paper, a transparent base layer 7 is formed, providing more desirable results. When the color toner use order is changed to BK→C→M→Y, the same desirable results are obtained.

Embodiment I-3

(BK→Y→M→C→T)

Figure 7:
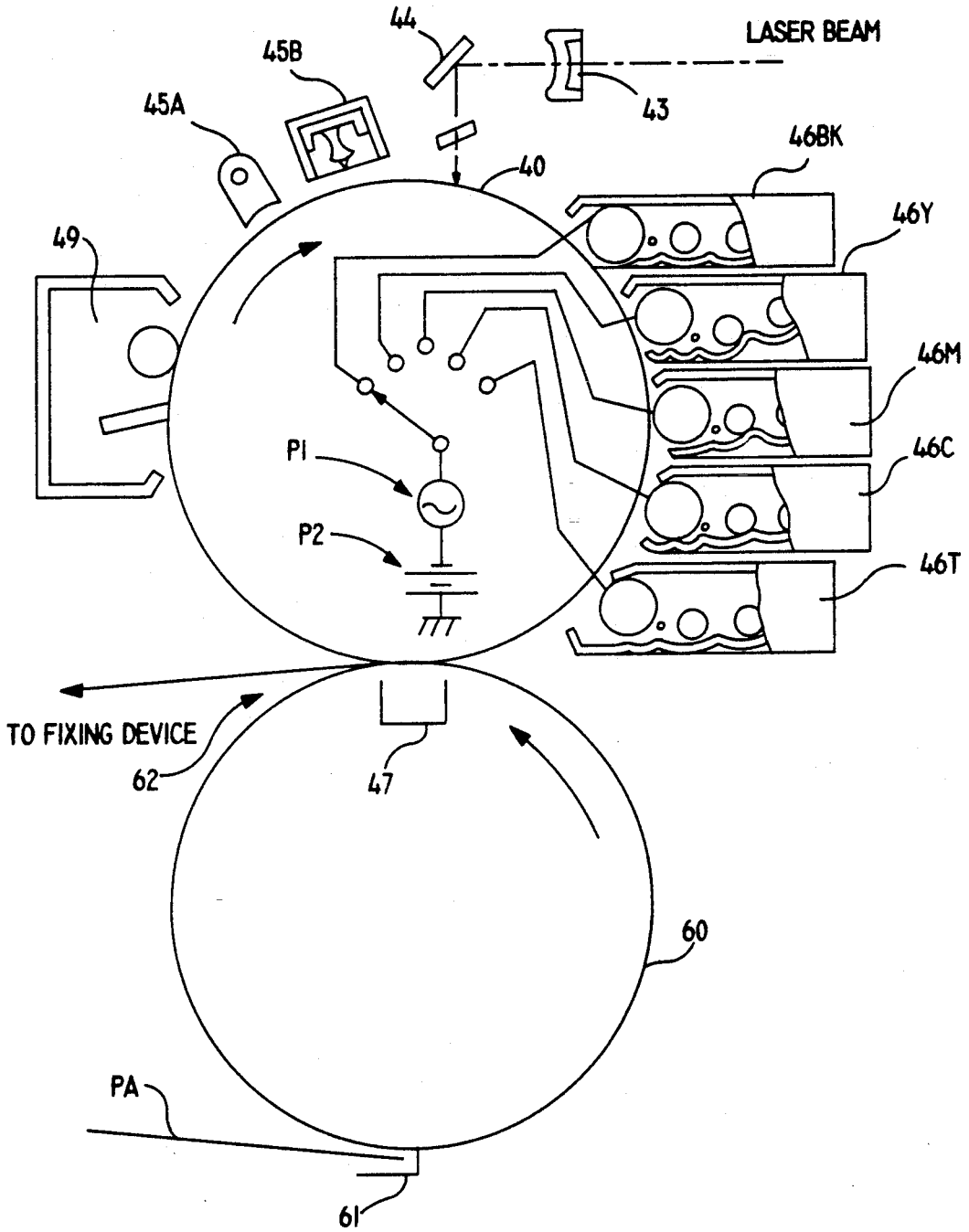
FIG. 7 shows a layout of units around a photo conductor of Embodiment I-3 using a transfer drum of the present invention.

This embodiment is an example of a color image forming apparatus using the transfer method using a transfer drum 60 shown in FIG. 7, and the developing unit layout is the same as that shown in FIG. 3. The same numbers are assigned to the same items as those in FIG. 3.

In this embodiment, during the first rotation of the photo conductor 40, a BK image signal is read by the image scanning section K in the same way as in Embodiment I-1 (FIG. 3) first, a laser beam is modulated by this signal, and the modulated laser beam is exposed as an image on the photo conductor, which is pre-exposed by the pre-exposure lamp 45A and uniformly charged by the charging unit 45B, via the rotational polygon mirror and fθ lens so as to form an electrostatic latent image.

This electrostatic latent image is subjected to non-contact reversal development by the developing unit 46BK which is applied with the AC bias voltage P1 and the DC bias voltage P2, and a BK toner image is formed on the photo conductor 40. The tip of the transfer paper PA is caught by a metal fitting on transfer drum 60, and the transfer paper PA is wound and secured onto drum 60. The BK toner image is transferred to transfer paper PA by the action of transfer electron 47. During the second rotation of the photo conductor 40, the photo conductor 40, which is pre-exposed and uniformly charged in the same way as with the first rotation, is image-exposed by the laser beam which is modulated by a Y image signal, and a Y toner image is formed on the photo conductor 40 by non-contact reversal development by the developing unit 46Y and superimposed on the Bk toner image of the transfer paper PA. During the 3rd and 4th rotations of the photo conductor 40, in the same way, by electrostatic latent image forming by a laser beam according to M and C image signals and development by the developing units 46M and 46C, an M and a C image are formed and superimposed on the transfer paper whenever each of them is formed so as to form color toner images. During the 5th rotation of the photo conductor 40, the image scanning section K, the laser writing section L, and the charging unit 45B are left unoperated, the photo conductor 40, which is pre-exposed and discharged by the pre-exposure lamp 45A, is subjected to non-contact reversal development by the developing unit 46T, which is filled with a developer containing colorless toner (a coloring agent is not contained), at the bias voltages P1 and P2 so as to form a transparent toner particle layer, and the transparent toner particle layer is transferred to the transfer paper holding the above color toner images. The transfer paper PA is separated from the drum 60 by action of a separation pawl 62 and fixed by a heat roller so as to form a color image with a transparent coating layer 8.

Embodiment I-4

(T→Y→M→C→BK)

In this embodiment, the developing units, which use the non-contact reversal development method, are located in the order of 46T, 46Y, 46M, 46C, and 46BK for the photo conductor 40 as shown in FIG. 5, and images are formed by a color image forming apparatus which uses the transfer method shown in Embodiment I-3, except that development starts with the transparent toner.

As an image forming method, during the first rotation of the photo conductor 40 at the time of copy start, the image scanning section K, the charging unit 45B, and the laser writing section L are left unoperated, a uniform transparent toner particle layer is formed on the photo conductor 40 which is uniformly pre-exposed by the pre-exposure lamp 45A and negatively charged by non-contact reversal development by the developing unit 46T and transferred to the transfer paper PA. By executing the image forming method comprising charging, image exposure, reversal development, and transfer shown in Embodiment I-1 for the above transparent toner particle layer, color toner images are formed by superimposing Y, M, C, and BK toner images, and the color toner images including the above transparent toner particle layer are transferred to the transfer paper PA in a batch in the same way as with Embodiment I-1 and fixed by a heat roller so as to form a color image having the transparent toner base layer 7 as a lower layer.

COMPARISION EXAMPLES I-3 AND I-4

Color images are formed in the same way as with Embodiments I-3 and I-4 except that no transparent toner is used.

In Embodiments I-3 and I-4, color images are deep in quality and superior in color tone and gradation, resulting in deep color images. Especially in Embodiment I-4, since the transparent toner becomes a lower layer on the transfer paper, more desirable results are obtained. When the color toner use order is changed to Y→M→C→BK, the same desirable results are obtained. In the comparison examples, the color tone and gradation are not good, and color images are flat.

Embodiment I-5

Figure 8:
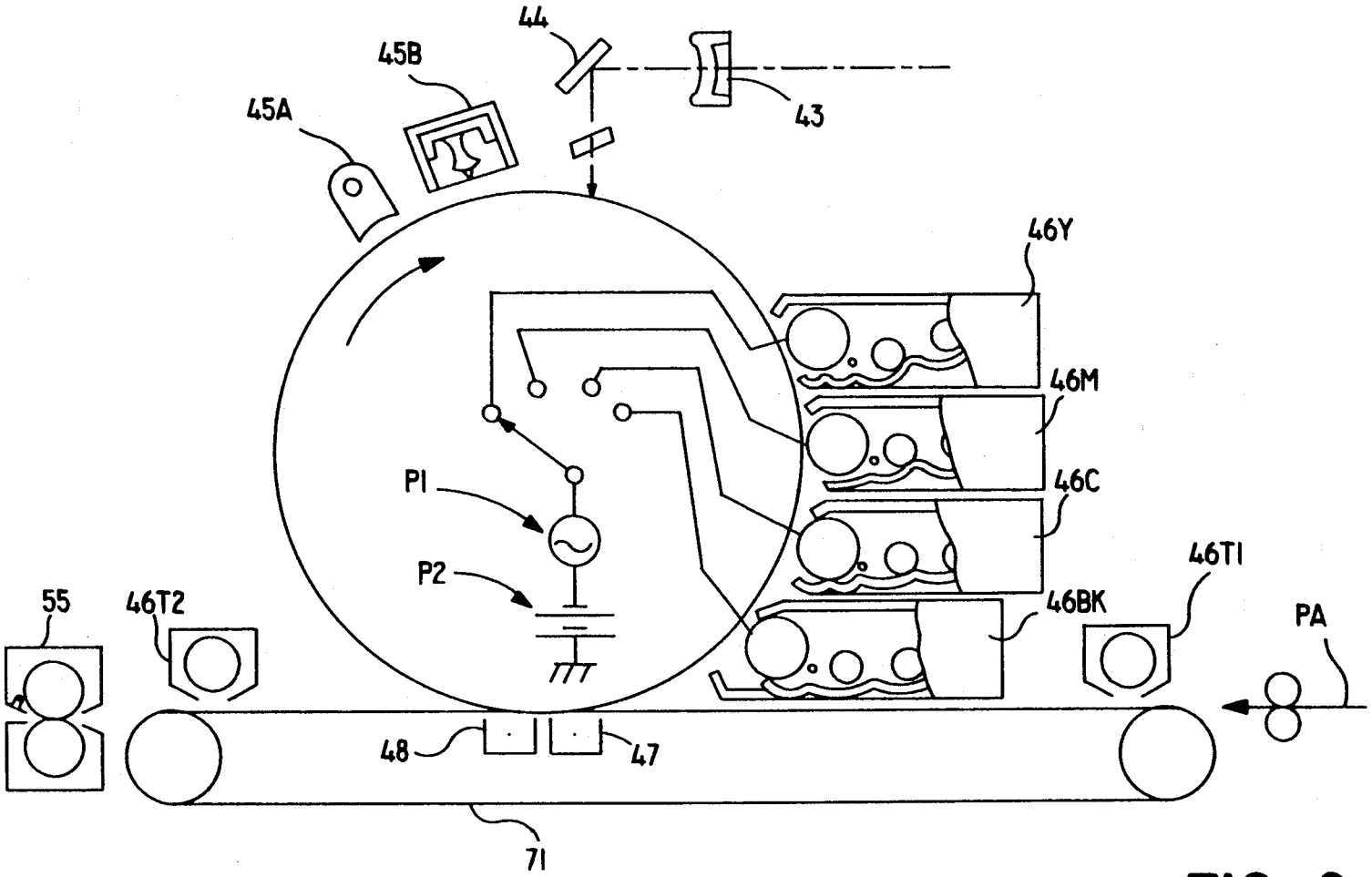
FIG. 8 shows a layout of units around a photo conductor of Embodiment I-5 of the present invention.

In this embodiment, images are formed by a color image forming apparatus which is the same as that used in Embodiment I-1, except that the developing unit 46T using the non-contact reversal development method shown in Embodiment I-1 is eliminated for the photo conductor 40 as shown in FIG. 8, the developing units 46 are located in the order of 46Y, 46M, 46C, and 46BK so as to develop from Y toner to BK toner, a conveyor belt 70 is installed between a timing roller 52 and a fixing unit 55, developing units 46T1 and 46T2 containing a developer and transparent toner are installed at both ends of the conveyor belt 70, and the transfer electrode 47 and the separation electrode 48 are mounted so as to function from the back of the conveyor belt 70.

As an image forming method, during the first rotation of the photo conductor at the time of copy start, by executing the image forming method comprising charging, image exposure, and reversal development shown in Embodiment I-1, color toner images are formed by superimposing Y, M, C, and BK toner images, and a uniform transparent toner particle layer is formed on the transfer paper PA or PB, which is fed by the timing roller 52, by the developing unit 46T1 whereto a sufficiently high DC bias voltage is applied. The above color toner images are transferred to the transfer paper PA or PB whereon the above transparent toner particle layer is formed by the transfer electrode 47 in a batch and separated from the photo conductor 40 by the separation electrode 48. A transparent toner particle layer is formed on the above color toner images by the developing unit 46T2, and the color toner images are fixed by the heat roller fixing unit 55 so as to form a color image with a transparent base layer 7 and a transparent coating layer 8. It is desirable that the developing units 46T1 and 46T2 are of a non-contact development type using two-component developers, though the developing unit 46T1 may be a contact development type using a one-component developer. It is needless to say that one of or both of the developing units 46T1 and 46T2 can be used.

Embodiment I-6

Figure 9:
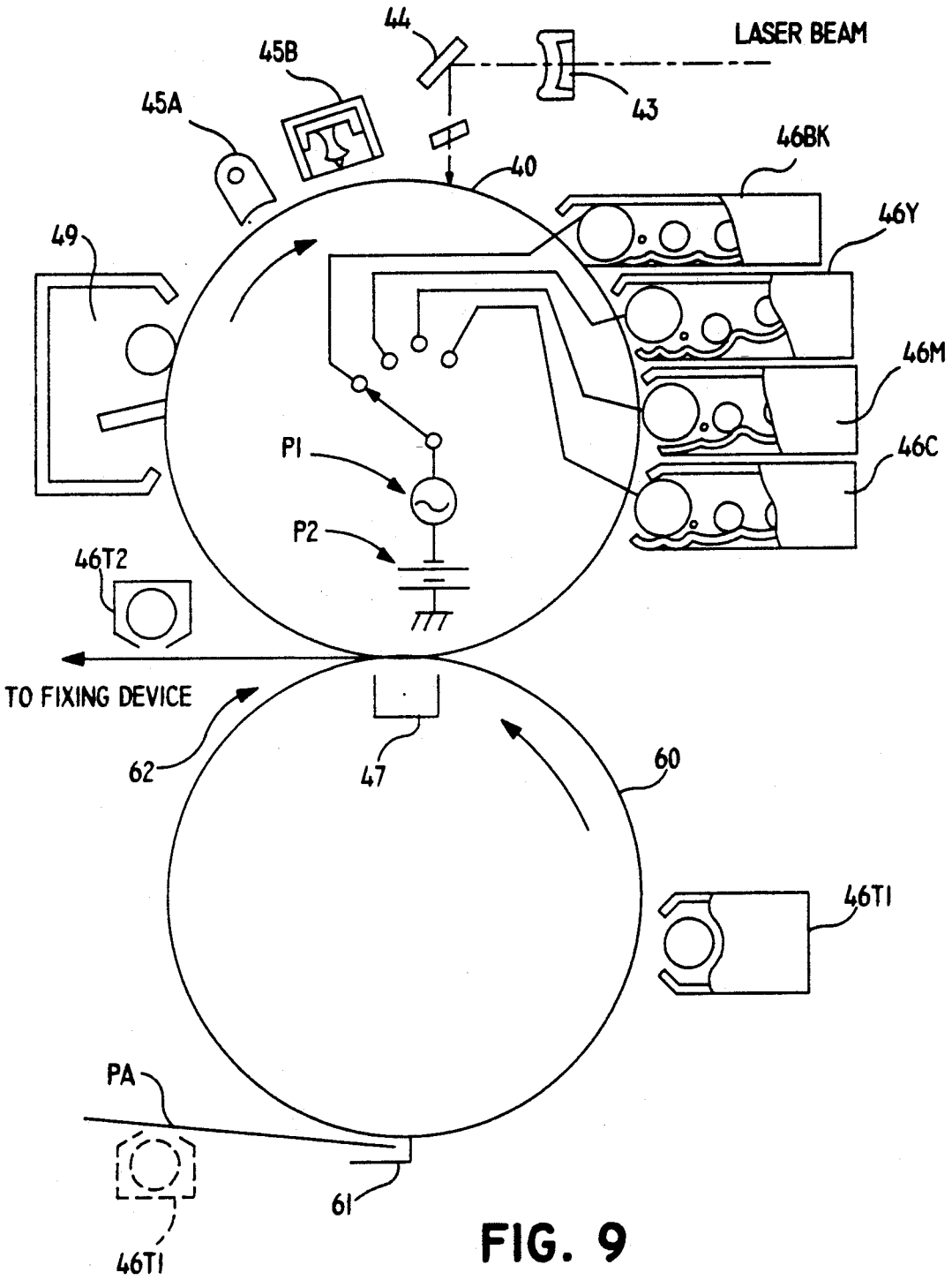
FIG. 9 shows a layout of units around a photo conductor of Embodiment I-6 of the present invention.

This embodiment is, as shown in FIG. 9, an example of a color image forming apparatus using the transfer method using a transfer drum which is the same as numeral 60 used in Embodiment I-3, and the layout of the developing units around the photo conductor 40 is the same as that of Embodiment I-3, except that the developing unit 46T is eliminated. A developing unit which is the same as 46T1 used in Embodiment I-5 is installed around the the transfer drum 60 and a developing unit which is the same as 46T2 used in Embodiment I-5 is installed in the upper path of the fixing unit of the transfer paper PA.

In this embodiment, a transparent toner particle layer is formed on the transfer paper PA on the transfer drum 60 by the developing unit 46T1, and each color toner images, which are formed on the photo conductor 40 in the same way as in Embodiment I-3, are transferred to and superimposed on the transfer paper PA on the transfer drum 60 by action of the transfer electrode 47. Thereafter, the transfer paper PA is fed to the fixing unit, a transparent toner particle layer is formed on the above color toner images by the above developing unit 46T2, and the color toner images are fixed by the heat roller fixing unit so as to form a color image with a transparent base layer 7 and a transparent coating layer 8. The developing unit 46T1 may be installed at the location indicated by a dotted line shown in FIG. 9 instead of the location indicated by a solid line. It is needless to say that one of or both of the developing units 46T1 and 46T2 can be used.

In the embodiments (1) to (6), the transparent toner layer is provided as an upper or lower layer. It is needless to say that it can be used as an upper and a lower layer of color toner layers.

The present invention is effective in preventing diffused reflection for a film of a transparent base such as OHP and produces the same effect for images.

According to the color image forming method of the present invention, as described above, a color image wherein color toner images are formed on a base and a transparent coating layer is formed on or under them is obtained; that is, a color image, which is superior in color tone and gradation and deep almost like silver halide color images can be obtained.

Embodiment II-1

Figure 11:
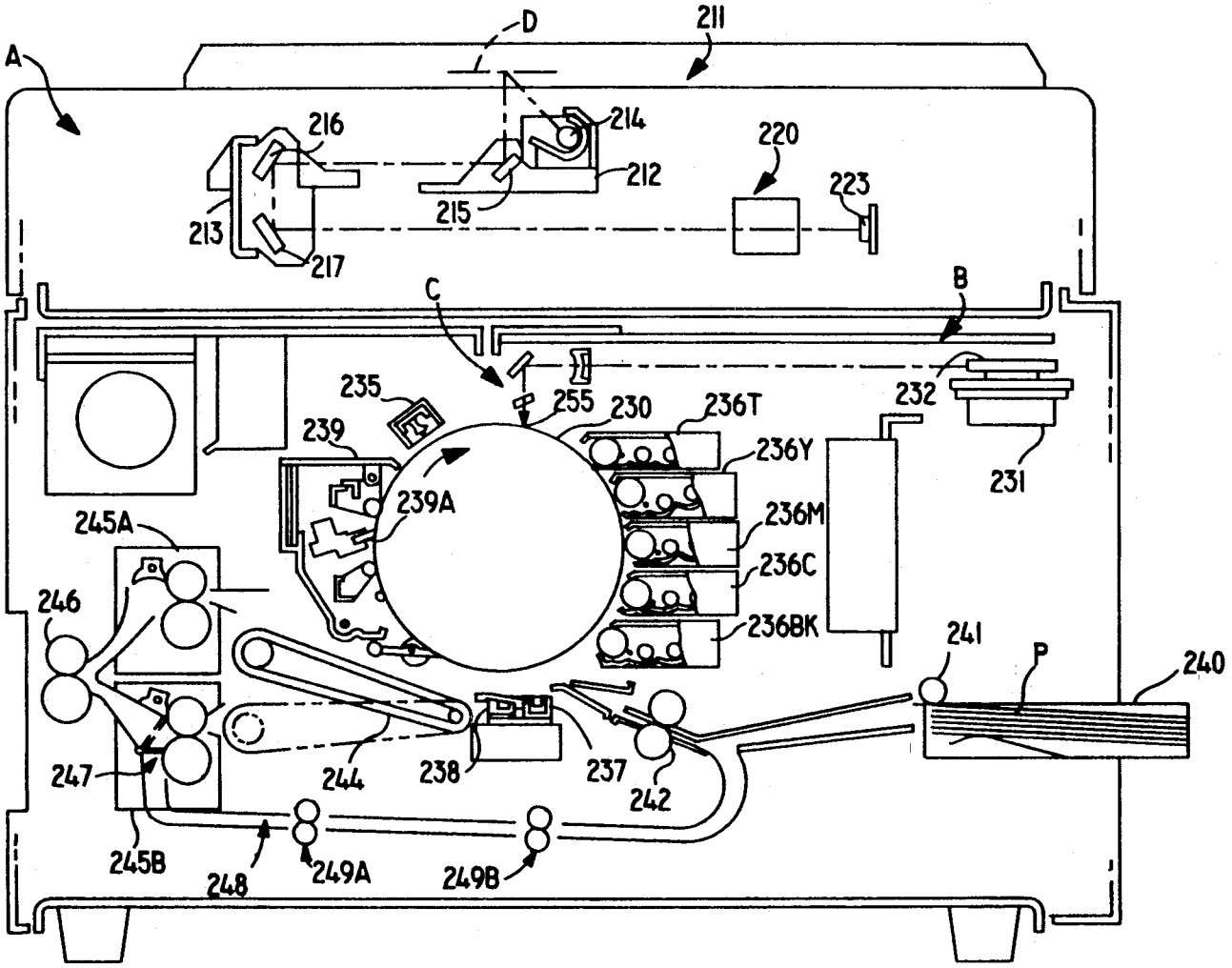
FIG. 11 is a sectional view of Embodiment II of a color image forming apparatus of the present invention.

Next, embodiments whereby the second object of the present invention is accomplished will be described. FIG. 11 is a sectional view of an embodiment of a color image forming apparatus of the present invention. The image forming apparatus comprises an image scanning system A, a laser writing system B, and an image forming section C.

On the upper part of the image forming apparatus, a document placement section 211 comprising a document plate having a transparent glass sheet and a document cover for a document D placed on the document plate. Under the document plate in the apparatus, the image scanning system A comprising a first mirror unit 212, a second mirror unit 213, a main lens 220, and a color CCD 223 is installed. The first mirror unit 212 comprises an exposure lamp 214 and a first mirror 215, and is mounted in parallel with the above document plate so that it can move linearly in the right and left direction on the drawing so as to scan optically on the overall surface of the document D. The second mirror unit 213 comprises a second mirror 216 and a third mirror 217 which are integrated and moves linearly in the right and left direction at a speed which is a half of that of the first mirror unit 212 so as to keep a predetermined optical path length. Of course, the second mirror unit 213 moves in parallel with the document plate in the same way as the first mirror unit 212. An image of the document D on the document plate which is lighted by the exposure lamp 214 is formed on the color CCD 223 by the main lens 220 via the first mirror 215, the second mirror 216, and the third mirror 217. When the scanning is finished, the first mirror unit 212 and the second mirror unit 213 return to their original positions and wait for the next copy.

Each color image data obtained by the color CCD 223 is image-processed and outputted from the laser writing system B as an image signal.

The image forming section C comprises a charging unit 235, an image exposure unit 255, developing units 236T, 236Y, 236M, 236C, and 236BK, a transfer unit 237, a separation unit 238, and a cleaning unit 239 which are installed around a photosensitive drum 230 which is an image forming unit, and a paper feed cassette 240, a conveyor belt 244, and fixing units 245A and 245B which are installed near the photosensitive drum 230.

Among the above developing units 236T, 236Y, 236M, 236C, and 236BK, the developing unit 236T containing transparent toner T is installed in the uppermost position of the running path around the photosensitive drum 230 and the developing unit 236BK containing black toner BK is installed in the lowermost position. As color toners and black toner BK, which are contained in the developing units 236Y, 236M, 236C, and 236Bk, those which are well known are used. Therefore, description of them will be omitted.

Transparent toner T which is contained in the developing unit 236T is made of resin with no coloring agent, for example, styrene-acrylic copolymer resin which is obtained from a copolymer of styrene monomer such as styrene, ester acrylate monomer such as butyl acrylate, and or ester methacrylate monomer such as methyl methacrylate. Thermoplastic resin such as polyester resin or thermosetting resin may be used.

The fixing unit 245A is a fixing unit which performs normal fixing. The fixing unit 245B is a fixing unit which is set so that the fixing temperature is higher than the general temperature, the pressure is higher than the general pressure, or the fixing time is longer than the general time, and wherein enhancement fixing for sufficiently melting and fixing toner images so as to be glossy by combining 2 or 3 of the above 3 conditions is set. The conveyor belt 244 is movable and transports transfer paper P to the fixing unit 245A in the case of normal non-glossy fixing. In the case of glossy fixing, the belt moves to the position indicated by a two-dot chain line and transports the transfer paper P to the fixing unit 245B

Figure 13:
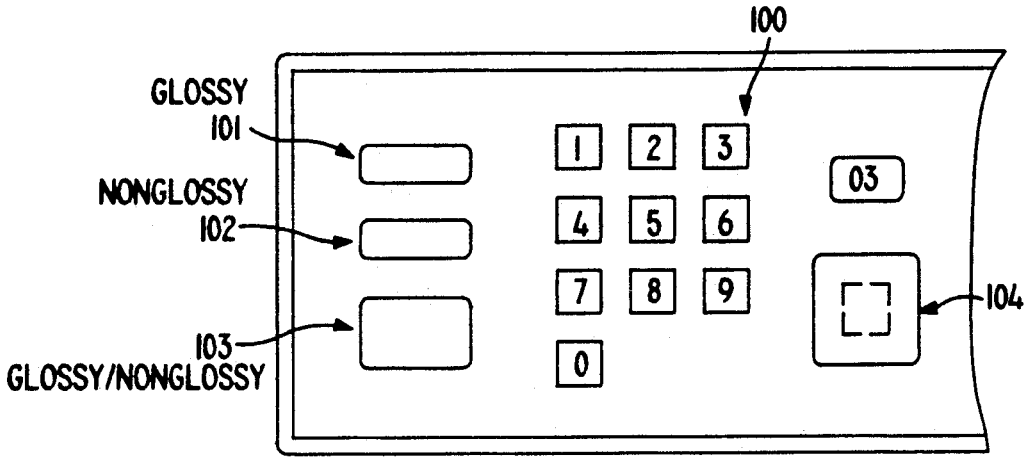
FIG. 13 is a plan view of the essential section of the operation unit.

In the color image forming apparatus of the present invention, one of the gloss mode, non-gloss mode, gloss and non-gloss mode can be selected. Before starting copy, the desired gloss mode for copied images can be selected via an operation panel 100 shown in FIG. 13.

When making copy images entirely glossy, a Gloss button 101 is pressed, when making copy images entirely nonglossy, a Nongloss button 102 is pressed, or when making copy images partially glossy, a Gloss and Nongloss button 103 is pressed.

When the Gloss and Nongloss button 103 is pressed, the glossy area of images is set by a method using an editor or a method using image discrimination.

Figure 14:
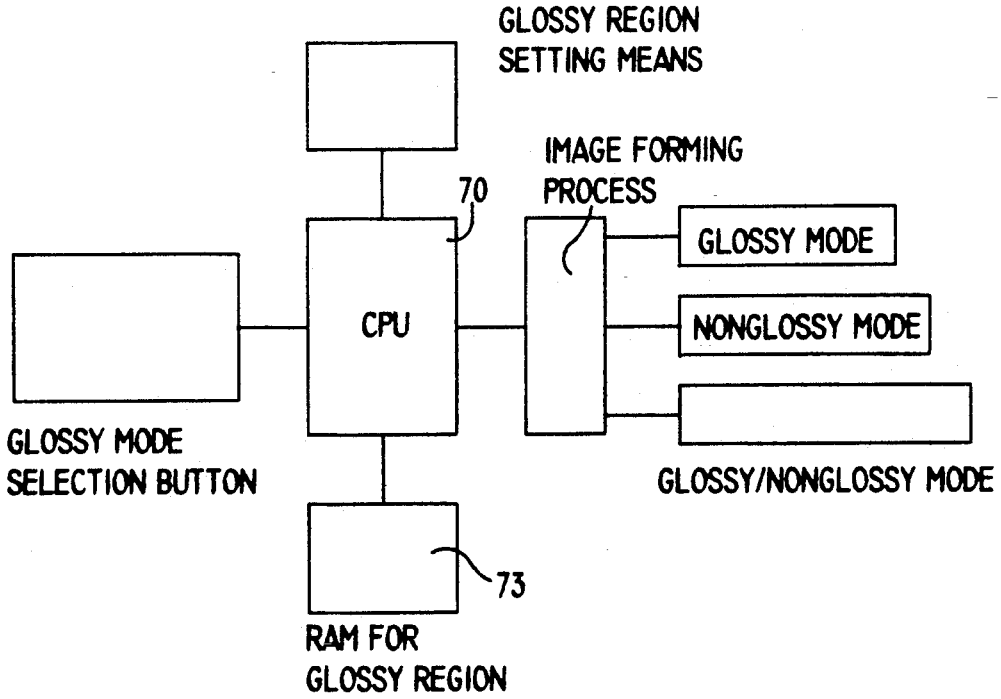
FIG. 14 is a block diagram of the control circuit.

As shown in FIG. 14, the image gloss mode and the glossy image area (gloss range) are inputted to a gloss range RAM 73 of a control unit, and a CPU 70 processes copy images, which are fixed according to the image forming process, in the gloss mode, the nongloss mode, or the gloss and nongloss mode which is preset.

First, a case that the gloss button 101 is pressed so as to set the gloss mode will be described.

In this case, the conveyor belt 244 is set at the position for transporting the transfer paper to the fixing unit 245B indicated by the two-dot chain line.

When a copy button 104 is pressed then the image scanning system A, the laser writing system B, and the image forming section C perform their processes so as to form copy color images. When an image signal from the image scanning system A is inputted to the laser writing system B comprising a drive motor 231, a polygon mirror 232, and a semiconductor laser, a $f\theta$ lens, and a correction lens, which are not shown in the drawing, by control of the CPU 70 of the control unit, the copy operation starts. The photosensitive drum 230 rotates clockwise as shown by the arrow and is charged uniformly by the charging unit 235, and a yellow (Y) image corresponding to the image of the document D is written by an image exposure unit using a laser beam from the laser writing system B so as to form an electrostatic latent Y image. The electrostatic latent image on the photosensitive drum 230 is reversely developed by Y toner of the developing unit 236Y so as to form a visible Y toner image. A developing sleeve containing a magnet roller of the developing unit 236Y is applied with a DC or furthermore an AC bias voltage and a Y toner image is formed by non-contact development by a two-component developer which is an image visualizing means. The photosensitive drum 230 which forms this Y toner image passes under the cleaning unit 239 which is separated from the drum and is charged by the charging unit 235, and a magenta (M) image is written by the laser beam of the laser writing system B and an electrostatic latent magenta (M) image is formed on the above Y toner image. This latent image is reversely developed by the developing unit 236M containing magenta toner so as to form an M toner image. Next, a cyan (C) toner image, a black (BK) toner image, and finally a transparent toner T layer (as mentioned above) are formed one by one. By doing this, a multi-color toner image with transparent toner T coated overall is formed on the photosensitive drum 230.

When the document D is a monochromatic image, only the developing units 236BK and 236T operate so as to form a black toner BK image with transparent toner T coated overall.

The transfer paper P, which is fed from the paper feed cassette 240 containing the transfer paper P, which is a transfer material, sheet by sheet by a paper feed roller 241, is sent onto the photosensitive drum 230 by a timing roller 242 which operates in synchronization with the above toner image on the photosensitive drum 230. The toner image on the photosensitive drum 230 is transferred to the transfer paper P by action of the transfer unit 237, the transfer paper P is separated from the photosensitive drum 230 by the separation unit 238 and sent to the fixing unit 245B via the conveyor belt 244 which moves to the position indicated by the two-dot chain line, and a copy, which is pressed between the heat fixing roller and pressure roller and fixed glossily, is ejected onto a tray installed outside the apparatus by the paper ejection rollers 246. By doing this, a glossy color copy with a transparent toner T layer coated overall the image area is obtained.

The photosensitive drum 230 continues rotation and toner, which remains on the drum surface without being transferred, is collected and cleaned by the cleaning unit 239 with a cleaning blade 239A which is released from separation, and the drum waits for the next copy.

Next, a case that the non-gloss mode is set will be described. In this case, when the non-gloss button 102 is pressed, the conveyor belt 244 is set at the position indicated by the solid line. In the copy process mentioned above, the developing unit 236T is controlled not so as to operate. Therefore, an electrostatic latent image is formed by Y, M, C, and BK image data, and reversal development is performed by Y, M, C, and BK toners so as to form a multi-color toner image on the photosensitive drum 230. The transfer paper P whereto the toner image is transferred is sent to the fixing unit 245A and fixed nonglossily, and a nonglossy copy is ejected from the apparatus via the paper ejection rollers 246.

When the gloss and nongloss mode is set, by pressing the gloss and nongloss button 103, the conveyor belt 244 is set at the position indicated by the two-dot chain line and a guide plate 247 is set at the position indicated by a dotted line.

Next, the copy image gloss range is set and then the copy button 104 is pressed. First, the process for setting the gloss range (glossy image area) using an editor will be described.

Figure 16:
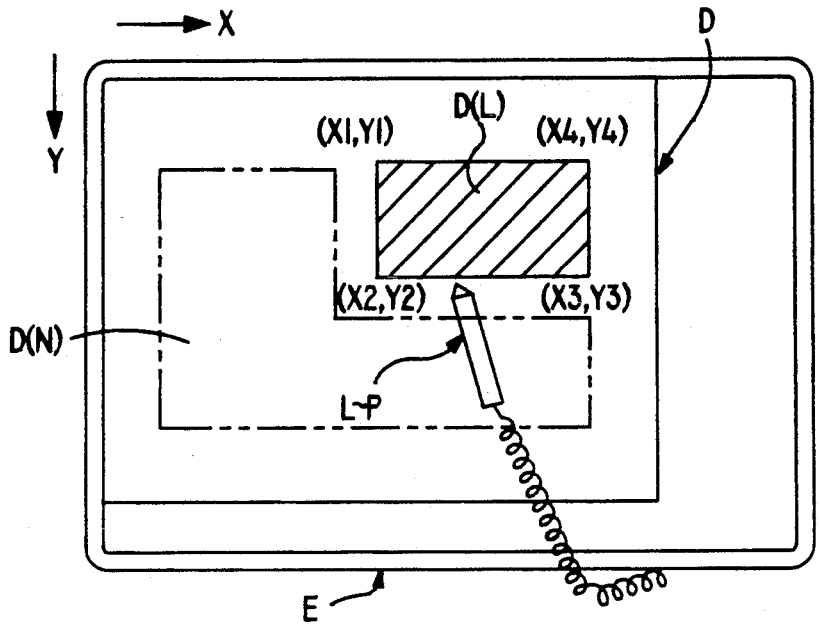
FIG. 16 is an illustration showing the setting of gloss range by an editor.

As shown in FIG. 16, the document D is placed on the editor E. It is assumed that the document D comprises a glossy section D (L) wherein gloss is required by photographs and a nonglossy section D (N) wherein nongloss is required. When the operator specifies the range (X1Y1, X2Y2, X3Y3, X4Y4) of the glossy section D (L) indicated by hatched lines with a light pen LP, the range is stored in the gloss range RAM 73 of the control unit as a gloss range.

When the copy button 104 is pressed, an image is exposed and then developed only in the gloss range firstly. The overall gloss range is exposed for transparent toner T and developed by the developing unit 236T containing transparent toner T, and the transfer paper P whereto the toner image and transparent toner T layer in the gloss range are transferred is fixed by the fixing unit 245B as a glossy image.

Figure 15A:
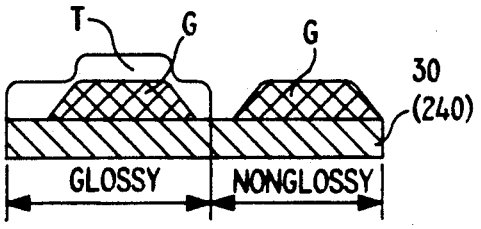
FIG. 15 is a sectional view of a toner image on a photo conductor formed by the present invention.
Figure 15B:
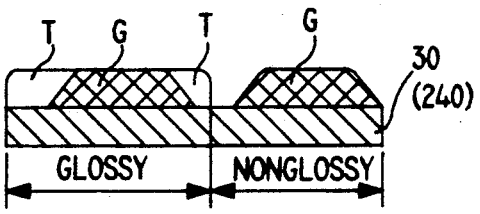
Figure 15C:
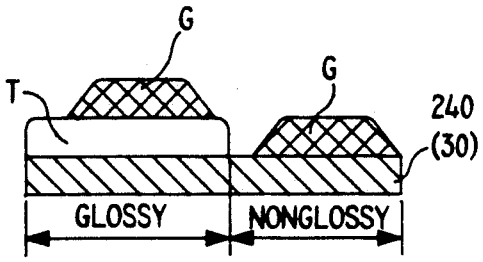
Figure 15D:
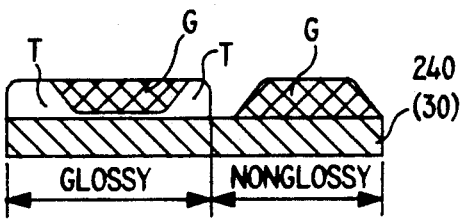

The fixed transfer paper P touches the guide plate 247, enters a reversal paper feed path 248, and is sent to the timing rollers 242 once again via feed rollers 249A and 249B. After this process, the second image exposure and subsequent development are performed in the nongloss image area (nongloss range) (in this case, transparent toner T image exposure and development are not performed), and the transfer paper P passes the transfer unit 237 and a color transfer image is transferred in the nongloss range on the same surface. The conveyor belt 244 is at the position indicated by the solid line, and the toner image is fixed nonglossily by the fixing unit 245A. By doing this, a glossy copy image is formed in the gloss range and a nonglossy image is formed in the nongloss range, the transparent layer forming and fixing processing according to the gloss and nongloss mode selected is performed, the gloss range and nongloss range are formed on the photo conductor as shown in FIG. 15(a), and as a result, a copy with the gloss and nongloss ranges is ejected from the apparatus.

Next, the process for setting the gloss range by image discrimination will be described.

Figure 17:
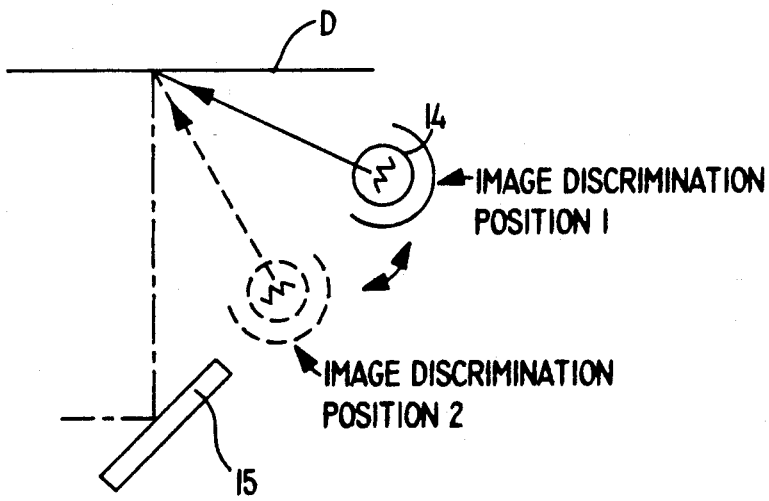
FIG. 17 is an illustration showing the glossiness detection method by preliminary scanning.

In this case, when the gloss and nongloss button 103 is pressed and then the copy button 104 is pressed, the image scanning system A scans the image preliminarily before reading and discriminates the glossy image section of the document D such as a photograph and the nonglossy image section such as characters, and the glossy image section is stored in the gloss range RAM 73 of the control unit. As to discrimination of the glossy section and the nonglossy section, as shown in FIG. 17, the exposure lamp 214 mounted to the first mirror unit 212 is moved between the image discrimination position 1 and the image discrimination position 2 cyclically during preliminary scanning, the incident angle of the light for the document D is changed cyclically, and the glossy section and nonglossy section of the image are discriminated from output changes of the color CCD 223.

Next, image scanning is performed, and a color copy which is partially glossy can be obtained through the process of image forming, transfer, and fixing in the same way as with setting of the gloss range by the editor E.

For a transparent toner T layer, as shown in FIG. 15(*b*), by changing the processing method for image data which is obtained on the photo conductor by the image scanning system A, a fixed amount of toner is always adhered. A transparent toner layer may be formed in an area where a small amount of color toner is adhered to the toner image in the gloss range.

In the above embodiment, the two fixing units 245A and 245B are used. However, it is possible that the fixing condition is changed from the glossy image forming condition to the nonglossy image forming condition only by the fixing unit 245B and a glossy image copy and a nonglossy image copy are obtained by the fixing unit 245B which is changeable. By doing this, the construction of the color image forming apparatus can be simplified much the more.

Embodiment

II-2 (Y→M→C→BK→T)

The image forming method for this embodiment can be realized by using the color image forming apparatus shown in FIG. 3 according to the time chart shown in FIG. 4.

In this apparatus, as described above, during the 3rd and 4th rotations of the photo conductor 40, via image exposure by the laser beam according to the C image signal, development by the developing unit 46C, image exposure by the laser beam according to the BK image signal, and development by the developing unit 46BK, a C toner image and a BK toner image are superimposed on the Y and M toner images on the photo conductor so as to form a color toner image. Next, the transparent toner particle layer is exposed by a laser beam of the laser writing section L according to the position specification described in Embodiment II-1, and developed reversely by the developing unit 46T.

By doing this, an image which has a glossy area in the area with toner adhered and an image which has a nonglossy area in the area with no toner adhered can be obtained simultaneously.

Embodiment II-3

Figure 12:
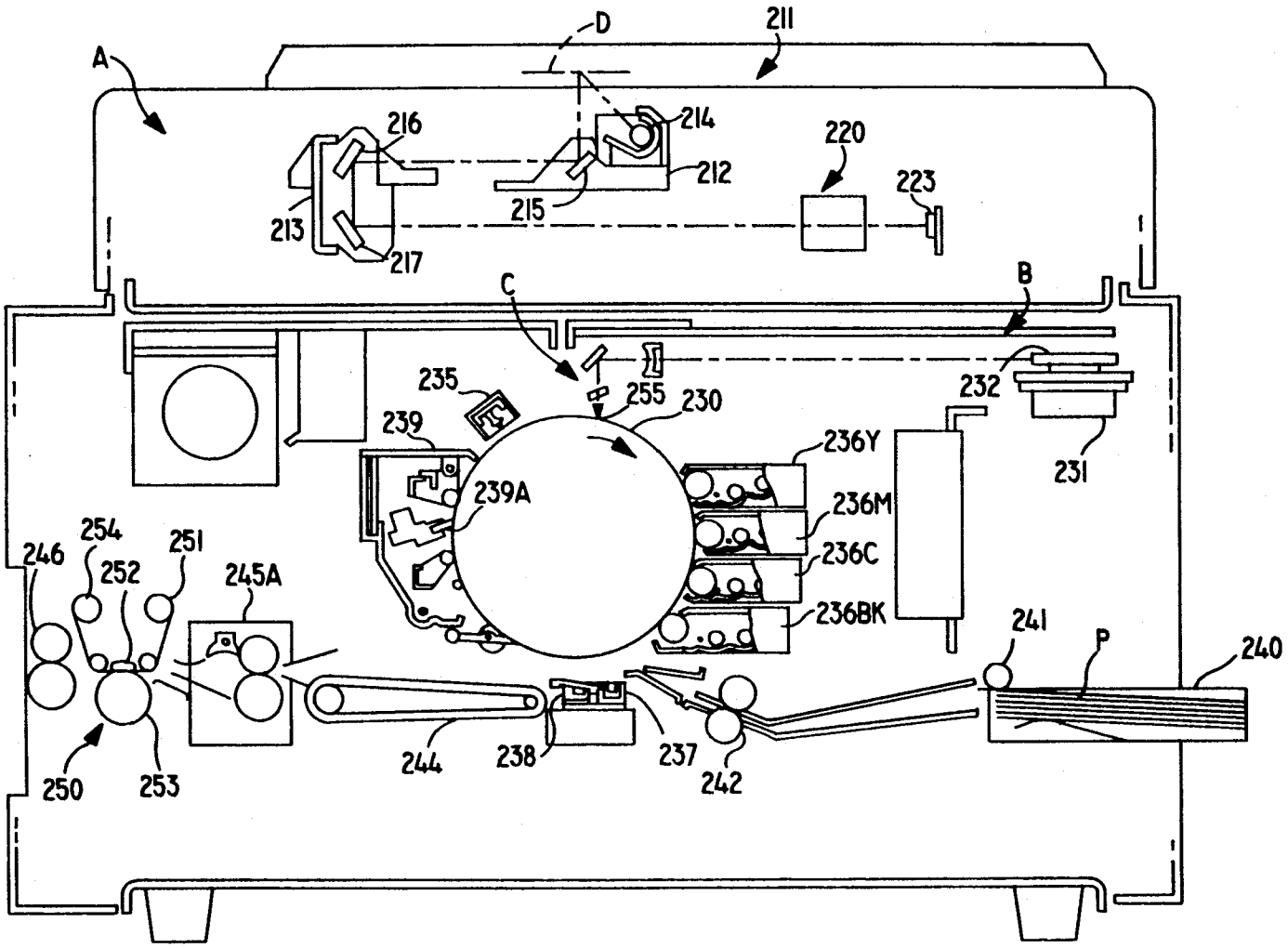
FIG. 12 is a sectional view of another embodiment of a color image forming apparatus of the present invention.

FIG. 12 is a sectional view of another embodiment of a color image forming apparatus of the present invention. To simplify the description, the same number is assigned to the section which corresponds to a section shown in FIG. 11. The construction of this embodiment is the same as that of the first embodiment, except that the developing unit 236T containing transparent toner T is eliminated, only the fixing unit 245A which is set to the normal fixing conditions is used, the conveyor belt 244 is fixed, and a transparent layer forming section 250 is newly installed between the fixing unit 245A and the paper ejection rollers 246.

The transparent layer forming section 250 comprises a heat transfer sheet feed section 251 which retains a heat transfer sheet for transferring a rolled transparent layer so as to freely feed them, a thermal head 252, a platen roller 253, and winding roller 254. The conducting condition of the thermal head 252 is controlled by the CPU 70 and the transparent layer of the heat transfer sheet can be transferred to the overall surface or in the specified gloss range of the transfer paper P.

The basic copy process of the third embodiment is almost the same as that of the first embodiment in the nongloss mode, and the transfer paper P, which is transferred with multiple color toner images and separated from the photosensitive drum 230, is normally fixed by the fixing unit 245A via the conveyor belt 244. In the transparent layer forming section 250, thereafter, the CPU 70, which operates according to each mode, allows the thermal head 252 to operate on the section of the transfer paper P which corresponds to the gloss range of image stored in the gloss range RAM 73 so as to transfer the transparent layer from the transfer sheet. By doing this, the transparent layer is superimposed in the gloss range on the photo conductor as shown in FIG. 15(a), and the transfer paper is made glossy including the section having no toner image and ejected from the apparatus by the ejection rollers 246.

Embodiment II-4

(T→Y→M→C→BK)

In this embodiment, images are formed by a color image forming apparatus which is the same as that used in Embodiment II-2, except that the developing units 46 using the non-contact reversal development method, which are used in Embodiment II-2 using the color image forming apparatus shown in FIG. 3, are installed in the order of 46T, 46Y, 46M, 46C, and 46BK for the photo conductor 40 as shown in FIG. 5 and the developing unit 46T develops transparent toner first.

As an image forming method, during the first rotation of the photo conductor 40 at the time of copy start, the photo conductor 40 is uniformly charged by the charging unit 45B, exposed by a laser beam of th laser writing section L according to the transparent toner adhesion position specification described in Embodiment II-1, and subjected to noncontact reversal development by the developing unit 46T so as to form a section with a transparent toner particle layer adhered. Next, the image forming method comprising charging, image exposure, and reversal development used in Embodiment 2 is performed, a Y toner image, an M toner image, a C toner image, and a BK toner image are superimposed so as to form color toner images, and the color toner images including the transparent toner particle layer are transferred to the transfer paper PA in a batch in the same way as with Embodiment 2 and fixed by the heat roller so as to form a color image having a transparent coating layer on the glossy section.

FIGS. 15(*a*) and 15(*b*) show the condition of the gloss range and the nongloss range of an image on the photo conductor 40 in Embodiments II-3 and II-4. The layer configuration when the order of the developing units is changed to Y→M→C→BK→T in Embodiment II-4 is as shown in FIG. 15(*a*).

As an embodiment for accomplishing the second object of the present invention, a color image forming apparatus wherein toner images are superimposed on the photo conductor is used. A color image forming apparatus wherein transfer paper is wound round the transfer section and toner images formed on the photo conductor are transferred and superimposed onto the transfer paper one by one may be used.

In this case, it is desirable that the toner use order is changed and the condition of superimposed toner images on the photo conductor 240 or 30 shown in FIG. 15 is formed on the transfer paper in the same way.

According to the present invention, a color image forming apparatus wherein the construction and process control as described above provide a copy image which is glossy on the overall surface thereof or the desired section thereof including a section having no toner image, and for a transparent sheet, a glossy copy with high saturation which is extremely transparent and clear is obtained can be provided.

Embodiment III-1

An embodiment for accomplishing the third object of the present invention will be described. In this embodiment, the color image forming apparatus shown in FIG. 11 is used.

Figure 18:
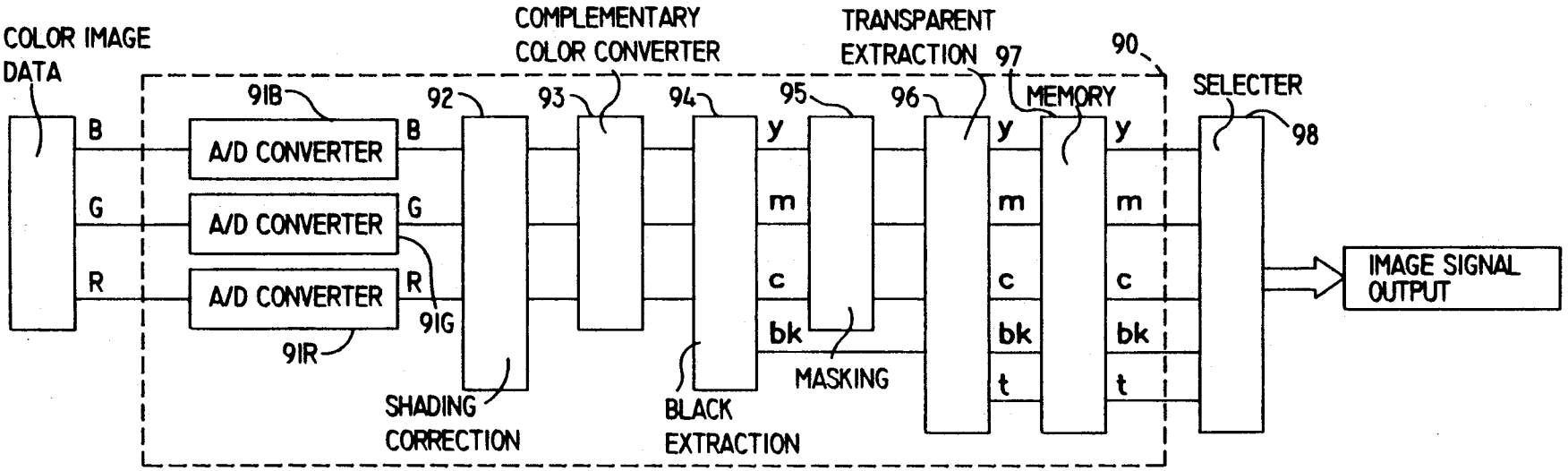
FIG. 18 is a block diagram showing an example of an image signal processor of Embodiment III of the present invention.

Image data obtained from the color CCD 223 by scanning is processed by an image signal processor 90 shown in FIG. 18 and outputted as an image signal to the laser writing system B via a selector 98.

The image signal processor 90 comprises A-D converters 91B, 91G, and 91R, a shading correction section 92, a complementary color converter 93, a black component extraction section 94, a masking section 95, a transparent component extraction section 96, and a memory 97.

The A-D converters 91B, 91G, and 91R convert color image data comprising blue (B), green (G), and red (R) image data, which can be inputted from the color CCD 223, to digital signals of color image data of, for example, 256 gradations and output them to the complementary color converter 93, which will be described later, after they are corrected for gradation improvement by the shading correction section 92.

The complementary color converter 93 performs complementary color conversion for digital signals of color image data, which are converted by the A-D converter 91 and corrected by the shading correction section 92, so as to obtain image data of yellow (Y), magenta (M), and cyan (C).

The black component extraction section 94 extracts black (BK) image data from Y, M, and C image data obtained by the complementary color converter 93, for example, by undercolor removal.

The masking section 95 corrects Y, M, and C image data after undercolor removal.

Figure 19A:
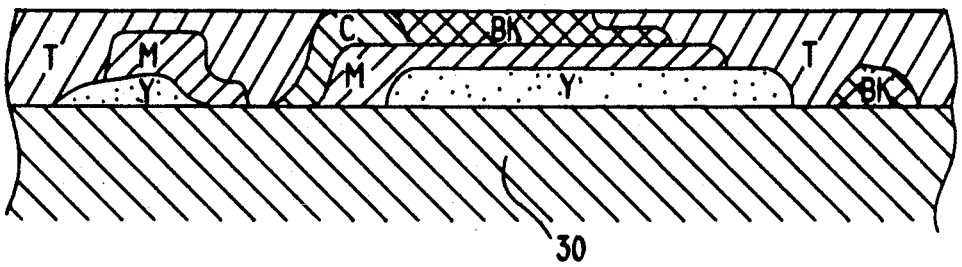
FIG. 19 is a sectional view showing the construction of each toner layer on a photo conductor formed by Embodiment III-1 of the present invention.
Figure 19B:
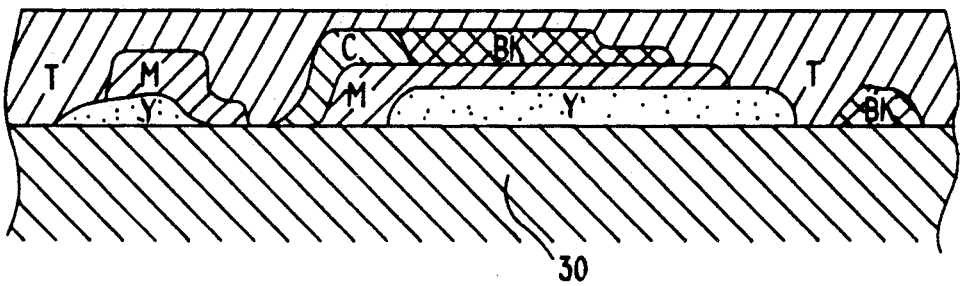
Figure 19C:
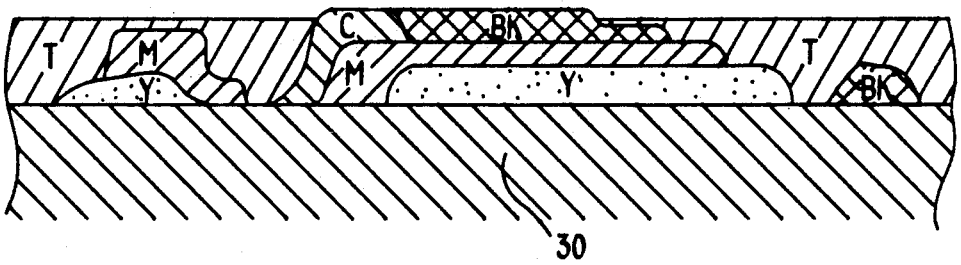

The transparent component extraction section 96 calculates the following equation from Y, M, and C image signals (y, m, c) corrected by the masking section 95 and a black component signal (bk) extracted by the black component extraction section 94 by undercolor removal and extracts a transparent component signal t.

$$t=Z-(y+m+c+bk)$$

where a symbol Z indicates a positive constant, desirably the maximum value of the sum of y, m, c, and bk or a larger constant. By doing this, the toner layer shown in FIG. 19 is formed on the photo conductor in the copy process which will be described later, and the toner layer is almost equal in thickness on the overall surface. When Z is the maximum value of the sum, transparent toner T is not adhered to the image section of the maximum density (FIG. 19 A). When Z is larger than the maximum value, some amount of transparent toner T is adhered to the image section of the maximum density (FIG. 19 B). When Z is smaller than the maximum value of the sum, FIG. 19 C is obtained. When Z is set as a comparatively small value and t is set as a negative value, it is required to add a condition for resetting t to 0.

The memory 97 stores color image data comprising Y, M, and C image data (y, m, c) corrected in color by the masking section 95, BK image data (bk) extracted by the black component extraction section 94, and transparent toner data (t) extracted by the transparent component extraction section 96. It is needless to say that the image processing mentioned above may be performed by a computer. The memory 97 may be eliminated by performing the scanning for each color.

Stored image data may be color or monochromatic image data which is created by a computer and stored in the memory 97.

When glossy copying is specified, therefore, a color toner image, which is glossily fixed, is formed on a transfer material having an area wherein color toners are melted and adhered and an area wherein transparent toner is melted. Since the adhesion amount of transparent toner T can be determined in consideration of the adhesion amount of the other toners, the entire toner layer is almost uniform in thickness overall the surface and an even copy can be obtained.

In the above embodiment, the two fixing units 245A and 245B are used. The type of fixing can be selected by movement of belt 244. When in the position shown in full lines in FIG. 11, belt 244 directs the copy to fixing unit 245A for normal, non-glossy fixing. If glossy fixing is desired, belt 244 is moved to the position shown in phantom in FIG. 11 so that it feeds the copy into fixing unit 245B. By doing this, the construction of the color image forming apparatus can be simplified much the more.

Embodiment III-2

Figure 20:
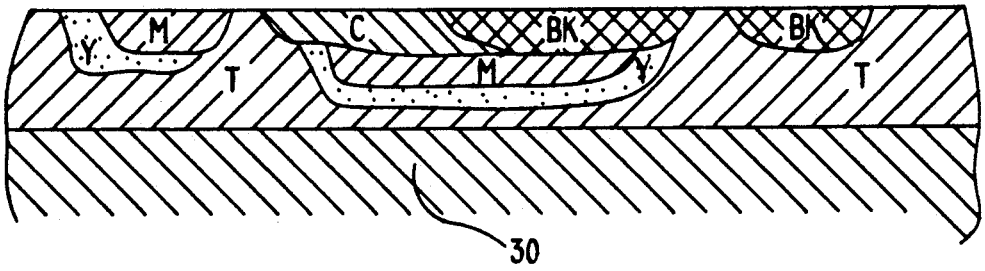
FIG. 20 is a sectional view showing the construction of a toner layer on a photo conductor formed by Embodiment III-2.

The color image forming apparatus shown in FIG. 11 is used in this embodiment. A transparent toner T layer is formed on the photo conductor 211 first and then toner images are superimposed on it in the order of Y, M, C, and BK by the process shown in Embodiment III-1, and the toner configuration shown in FIG. 20 is obtained. This color toner image is transferred to the transfer paper P and glossily fixed, and a color image or a monochromatic image which is even and glossy can be obtained. A transparent toner layer is formed on the color toner layers on the transfer paper.

Embodiment III-3

This embodiment uses a color image forming apparatus using the transfer drum 60 and the transfer method shown in FIG. 7. The same number is assigned to the same section shown in FIG. 3.

In this embodiment, during the first rotation of the photosensitive drum 40, a BK image signal is read by the image scanning system A in the same way as with Embodiment I-1 (FIG. 3), the laser beam is modulated by this signal, the modulated laser beam is exposed as an image on the photo conductor, which is uniformly charged by the charging unit 45 beforehand, via the rotational polygon mirror and fθ lens, and an electrostatic latent image is formed.

Figure 21:
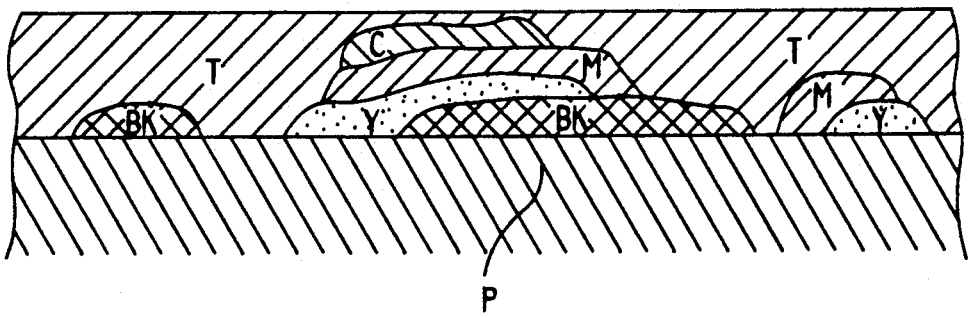
FIG. 21 is a sectional view showing the construction of a toner layer on transfer paper formed by Embodiment III-3.

This electrostatic latent image is subjected to non-contact reversal development by the developing unit 46BK which is applied with an AC bias voltage and a DC bias voltage, and a BK toner image is formed on the photosensitive drum 40. The tip of the BK toner image is caught by a metal fitting of the transfer drum 60 and transferred to the transfer paper P, which is wound and secured onto the drum 60, by action of the transfer unit 47. During the second rotation of the photosensitive drum 40, the photosensitive drum 40, which is uniformly charged in the same way as with the first rotation, is image-exposed by the laser beam which is modulated by a Y image signal, and a Y toner image is formed on the photosensitive drum 40 by non-contact reversal development by the developing unit 46Y and superimposed on the Bk toner image of the transfer paper P. During the 3rd and 4th rotations of the photo conductor 40, in the same way, by electrostatic latent image forming by a laser beam according to M and C image signals and development by the developing units 46M and 46C, an M and a C image are formed and superimposed on the transfer paper whenever each of them is formed so as to form color toner images. During the 5th rotation of the photosensitive drum 40, a latent image is formed by a transparent component signal t which is obtained by the image scanning system A and is the same as that in Embodiment III-1, the laser writing system photosensitive drum 40 is subjected to non-contact reversal development by the developing unit 46T, which is filled with a developer containing transparent toner T (a coloring agent is not contained), at the AC and DC bias voltages so as to form a transparent toner T section, and the transparent toner T section is transferred to the transfer paper P holding the above color toner images. The transfer paper PA is separated from the transfer drum 60 by action of a separation pawl 62 and fixed glossily, and an even and glossy color: image having the transparent toner T section which is an area where transparent toner T is adhered as shown in FIG. 21 is formed. It is possible that the developing unit 46T is left unoperated, no transparent toner T section is formed, and a normal color image is formed by normal fixing.

Embodiment III-4

In this embodiment, images are formed in the same way as with Embodiment 3, except that the developing units, using the non-contact reversal development method, of a color image forming apparatus having the transfer drum 60 of Embodiment III-3 (FIG. 7), are installed in the order of 46T, 46Y, 46M, 46C, and 46BK for the photosensitive drum 40 and transparent toner T is developed first.

Figure 22:
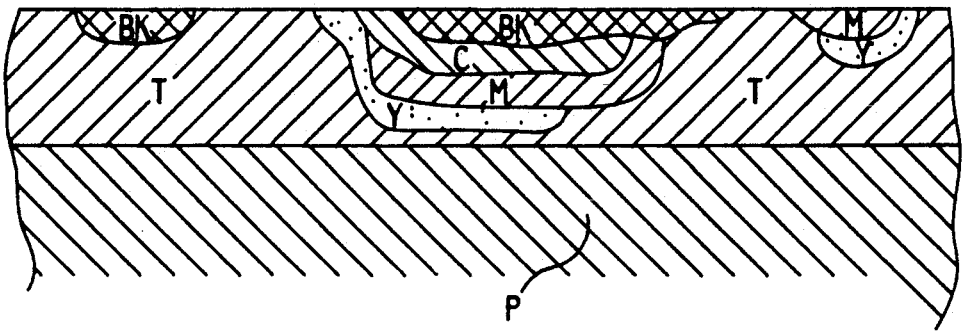
FIG. 22 is a sectional view showing the construction of a toner layer on transfer paper formed by Embodiment III-4.

As an image forming method, during the first rotation of the photosensitive drum 40 at the time of copy start, the image scanning system A, the charging unit 45, and the laser writing system B are left unoperated, a uniform transparent toner T section is formed on the photosensitive drum 40 which is negatively charged by non-contact reversal development by the developing unit 46T and transferred to the transfer paper P by action of the transfer unit 47. By executing the image forming method comprising charging, image exposure, reversal development, and transfer shown in Embodiment I-1 for the above transparent toner T section, color toner images are formed by superimprsing Y, M, C, and BK toner images, and the color toner images including the above transparent toner T section are formed on the transfer paper P on the transfer drum 60. Thereafter, the transfer paper P is sent to the fixing unit and fixed glossily. In this case, the above color toner images are on the transparent toner T section formed by the developing unit 46T as shown in FIG. 22, and an even and glossy color image can be formed.

Embodiment III-5

Figure 23:
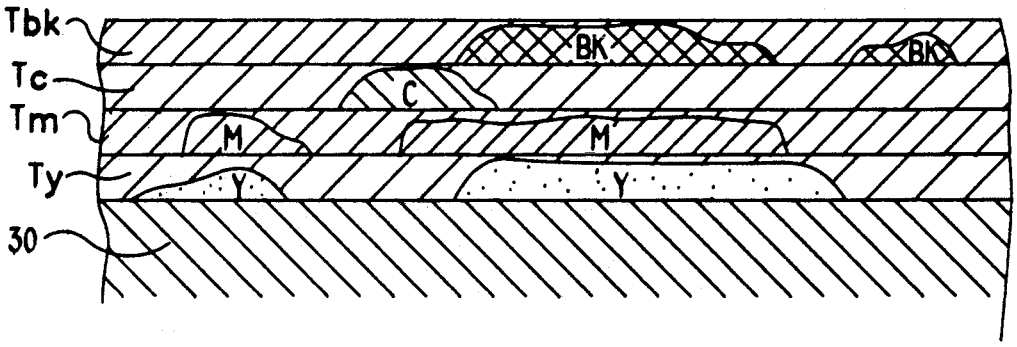
FIG. 23 is a sectional view showing the construction of a toner layer on a photo conductor formed by Embodiment III-5.

This embodiment indicates a color image forming method for forming color toner images having the toner layer configuration shown in FIG. 23 by the color image forming apparatus shown in FIG. 11.

The transparent toner T section by the developing unit 236T is formed for each toner layer, and transparent component signals ty, tm, tc, and tbk of the Y, M, C, and BK toner layers are obtained by the following calculations.

$$ty = Zy - y$$

$$tm = Zm - m$$

$$tc = Zc - c$$

$$tbk = Zbk - bk$$

where symbols Zy to Zbk indicate positive constants, desirably the maximum values of y, m, c, and bk or larger constants. By doing this, each color toner layer is almost equal in thickness on the overall surface. When Zy to Zbk are set as comparatively small values and ty to tbk are set as negative values, it is required to add a condition for resetting ty to tbk to 0.

Embodiment III-6

Figure 24:
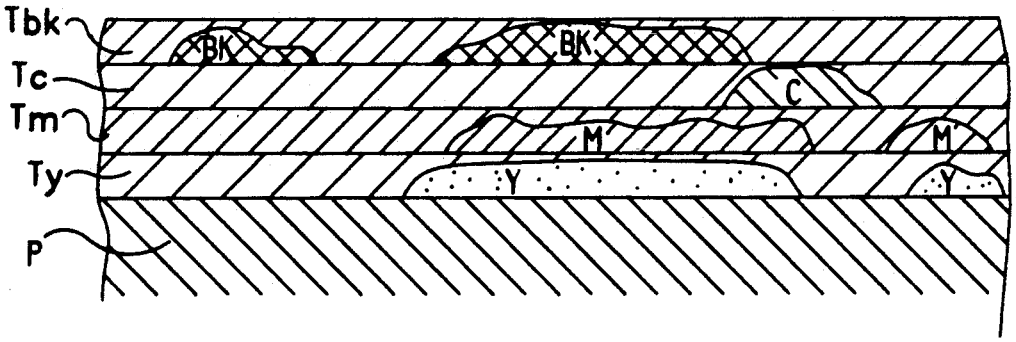
FIG. 24 is a sectional view showing the construction of a toner layer on a photo conductor formed by Embodiment III-6.

This embodiment indicates a color image forming method for forming the toner layer configuration shown in FIG. 24 by the method shown in Embodiment III-5 using a color image forming apparatus having the transfer drum 60 shown in FIG. 7. The transparent toner T section is formed for each toner layer and each color toner layer is almost equal in thickness on the overall surface.

Embodiment III-7

A transparent toner T section used in the above embodiments can be selectively set in one image. For example, a transparent toner T section can be selectively formed in the area specified by the editor or the glossy image section (a photograph is attached in an image). In conventional embodiments, the gloss developing unit or the nongloss developing unit is selectively used. In this case, however, one of them is used. Under the same fixing conditions, the gloss of the area using transparent toner is improved. As a means for improving the gloss furthermore, decreasing the glass transition temperature $T_g^T$ of the transparent toner lower than the glass transition temperature $T_g^C$ of color toners is effective.

For example, using a color toner of $T_g^C = 57°$ C. and a transparent toner of $T_g^T = 52°$ C., the above embodiments (1) to (6) are executed. A desirable result that the gloss of the area where toner is used is high and the gloss of the area where no toner is used is low is obtained.

The experiment shows that $T_g^T$ ranges from 50° to 60° C. and $T_g^C$ ranges from 53° to 65° C. and "$T_g^C - T_g^T$" is desirably between 3° and 15° C. When the above difference is lower than the range, the difference between gloss and nongloss is not sufficient. When the difference is higher than the range an offset easily occurs.

As described above, the present invention provides a method that a color copy which is glossy and even can be obtained for general transfer paper and when a transparent sheet is used as a transfer material, a projectable and superior copy of an image which is transmittal, free of diffused reflection, clear, and excellent in saturation can be obtained.

What is claimed is:

1. An apparatus for forming a color image on a recording material comprising an image carrier including an imaging surface on which a toner image is formed;

a transfer device for transferring said toner image from said imaging surface to said recording material;

an applier for applying a transparent toner layer on said recording material;

a control for controlling said applier to apply said transparent toner layer on a part of said recording material, and a reader for reading an original image on a document to be copied and a measuring device for measuring the glossiness of said document, wherein said control controls the applier in accordance with the measured glossiness of said document.

2. The apparatus of claim 1 wherein said applier applies said transparent toner on said imaging surface and said transfer device transfers said applied transparent toner together with said toner image from said imaging surface to said recording sheet.

3. An apparatus for forming a color image on a recording material comprising an image carrier including an imaging surface on which a toner image is formed;

a transfer device for transferring said toner image from said imaging surface of said image carrier to said recording material;

an applier for applying a transparent toner onto said recording material;

a reader for reading an image on an original document to be copied on said recording material;

a discriminator for determining whether said image is a glossy image for a nonglossy image, thereby producing a discrimination result; and a control for controlling said applier to apply said transparent toner in accordance with said discrimination result.

4. The apparatus of claim 3 wherein said discriminator measures the glossiness of said image.

5. The apparatus of claim 3 wherein said applier is so controlled that said transparent toner is applied onto said glossy image and is not applied onto said nonglossy image.

6. The apparatus of claim 3 further comprising a first fixing unit for fixing a nonglossy image and second fixing unit for fixing a glossy image, wherein said control selects one of said first unit or said second unit in accordance with said discrimination result.

7. The apparatus of claim 3 wherein said applier applies said transparent toner on said imaging surface and said transfer device transfers said applied transparent toner together with said toner image from said imaging surface to said recording sheet.

8. An apparatus for copying a color image on an original comprising:

an image carrier including an imaging surface;

a reader for reading said color image on said original;

a former for forming a latent image corresponding to said color image on said imaging surface;

a developing device for developing said latent image with a recording color toner to form a recording color toner image;

a transfer device for transferring said recording color toner image from said imaging surface to a recording sheet;

a designating device for designating a glossy region on said original; and an applier for applying a transparent toner on a part of said recording sheet corresponding to said designated glossy region, whereby a transparent toner can be applied on said recording sheet independently of said reader.

9. The apparatus of claim 8 wherein said applier applies said transparent toner on a part of said imaging surface corresponding to said designated glossy region and said transfer device transfers said applied transparent toner together with said recording color toner image from said imaging surface to said recording sheet, whereby said part of said recording sheet corresponding to said designated glossy region is applied with said transparent toner.

10. The apparatus of claim 8 wherein said applier applies said transparent toner directly to said part of said recording sheet corresponding to said designated glossy region.

11. An apparatus for forming a color image on a recording material; comprising:

an image carrier including an imaging surface;

a reader for reading said color image by a charged coupled device in a form of pixels each including plural color component signals;

a former for forming plural latent images corresponding to said plural color component signals for each pixel on said imaging surface of said image carrier;

a developing device for developing said plural latent images with plural color toners so as to superimpose plural color toner images for each pixel on said imaging surface;

an applier for applying a transparent toner on said imaging surface;

a process device for processing plural color component signals whereby, when a toner amount of plural color toner images of a pixel is smaller than a predetermined amount, said applier applies said transparent toner on said pixel.

12. The apparatus of claim 11 wherein said process device controls said applier in such a manner that a sum of said toner amount of plural color toner images and said transparent toner amount of said pixel is not larger than a predetermined amount.

* * * * *